US006424300B1

(12) United States Patent
Sanford et al.

(10) Patent No.: US 6,424,300 B1
(45) Date of Patent: Jul. 23, 2002

(54) NOTCH ANTENNAS AND WIRELESS COMMUNICATORS INCORPORATING SAME

(75) Inventors: Gary George Sanford, Apex; Howard E. Holshouser, Efland, both of NC (US)

(73) Assignee: Telefonaktiebolaget L.M. Ericsson (SE)

( * ) Notice: Subject to any disclaimer, the term of this patent is extended or adjusted under 35 U.S.C. 154(b) by 7 days.

(21) Appl. No.: 09/698,600

(22) Filed: Oct. 27, 2000

(51) Int. Cl.[7] ..... H01Q 1/24

(52) U.S. Cl. ..... 343/702; 343/700 MS; 343/767

(58) Field of Search ..... 343/700 MS, 702, 343/767, 770, 860, 863, 908

(56) References Cited

U.S. PATENT DOCUMENTS

| | | | | |
|---|---|---|---|---|
| 4,313,119 | A | 1/1982 | Garay et al. | 343/702 |
| 4,500,887 | A | 2/1985 | Nester | 343/700 |
| 4,571,595 | A | 2/1986 | Phillips et al. | 343/745 |
| 4,591,863 | A | 5/1986 | Patsiokas | 343/702 |
| 4,723,305 | A | 2/1988 | Phillips et al. | 455/89 |
| 4,843,403 | A | 6/1989 | Lalezari et al. | 343/767 |
| 4,853,704 | A | 8/1989 | Diaz et al. | 343/767 |
| 4,876,552 | A | 10/1989 | Zakman | 343/702 |
| 5,081,466 | A | 1/1992 | Bitter, Jr. | 343/767 |
| 5,185,611 | A | 2/1993 | Bitter, Jr. | 343/702 |
| 5,467,099 | A | 11/1995 | Bonebright et al. | 343/767 |
| 5,748,152 | A | 5/1998 | Glabe et al. | 343/767 |
| 6,246,377 | B1 * | 6/2001 | Aieollo et al. | 343/770 |
| 6,317,094 | B1 * | 11/2001 | Wu et al. | 343/767 |

FOREIGN PATENT DOCUMENTS

JP 40897759 A * 4/1996 ..... H01Q/1/24

OTHER PUBLICATIONS

William O. Camp, Jr., U.S. patent application Ser. No. 09/193,587, entitled *Portable Radiotelephones Including patch Antennas*, filed Nov. 17, 1998.

http://www.fcc.gov/e911, Document 94–102, FCC Requirements for Enhanced 911 (E911) Call Completion.

* cited by examiner

*Primary Examiner*—Hoanganh Le
*Assistant Examiner*—Shih-Chao Chen
(74) *Attorney, Agent, or Firm*—Myers Bigel Sibley & Sajovec

(57) ABSTRACT

Small, low cost, notch antennas are provided that can be internally incorporated into the existing structure of wireless communicators, and that are functional in a variety of orientations of the wireless communicator. The notch antenna is preferably formed in the ground plane conductor of a printed circuit board (PCB) that has RF circuitry thereon for receiving and transmitting RF signals. The notch preferably has a configuration that results in electromagnetic waves having a substantially omnidirectional radiation pattern being radiated from the notch when RF signals are applied to the notch. Integrating the antenna function into the same printed circuit board (PCB) on which the transmitter and/or receiver functions are also located eliminates the need for an additional antenna component. However, if necessary, a notch antenna surface component is also provided.

50 Claims, 16 Drawing Sheets

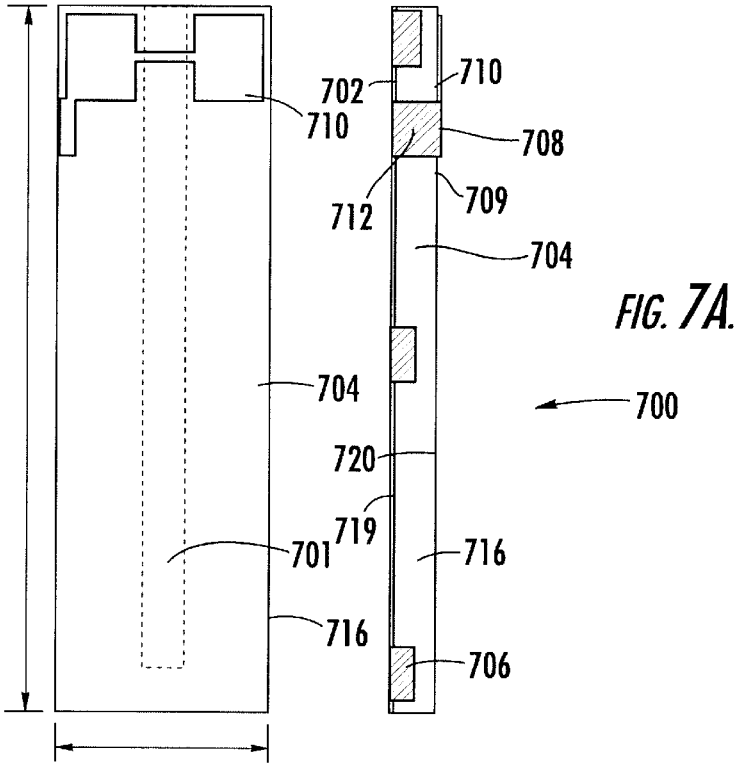
FIG. 7A.
FIG. 7D.
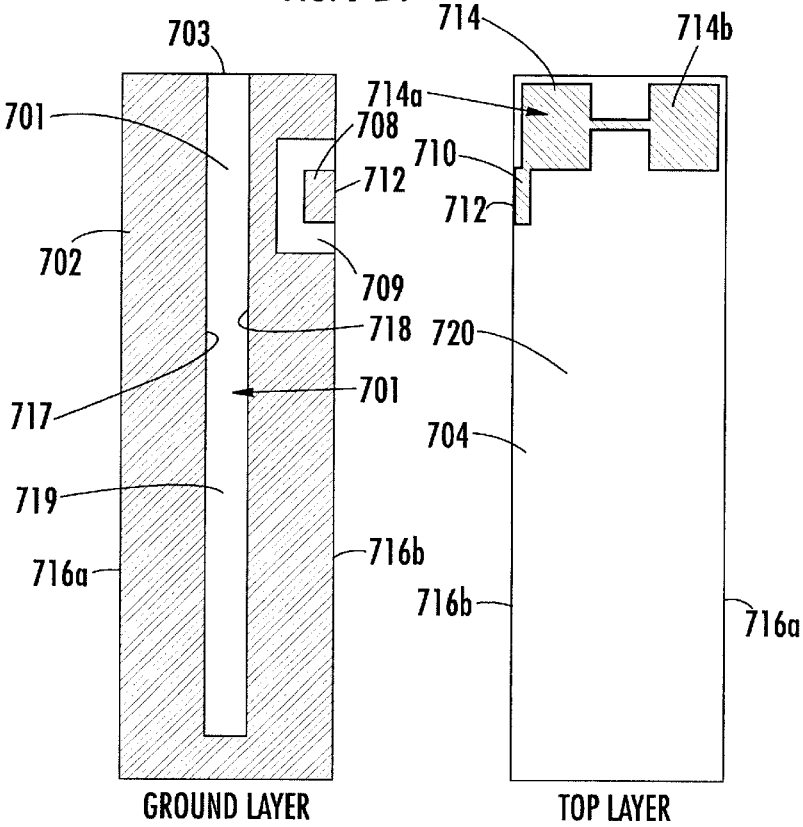
FIG. 7B.
FIG. 7C.

NOTCH ANTENNAS AND WIRELESS COMMUNICATORS INCORPORATING SAME

BACKGROUND OF THE INVENTION

The present invention relates generally to antennas, and more particularly to antennas used with wireless communications devices. Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

It is also becoming desirable for radiotelephones to be able to operate within multiple frequency bands in order to utilize more than one communications system. For example, GSM (Global System for Mobile) is a digital mobile telephone system that operates from 880 MHz to 960 MHz. DCS (Digital Communications System) is a digital mobile telephone system that operates from 1710 MHz to 1880 MHz. The frequency bands allocated for cellular AMPS (Advanced Mobile Phone Service) and D-AMPS (Digital Advanced Mobile Phone Service) in North America are 824–894 MHz and 1850–1990 MHz, respectively. Since there are two different frequency bands for these systems, radiotelephone service subscribers who travel over service areas employing different frequency bands may need two separate antennas.

There is also a growing trend towards development of radiotelephones which perform multiple functions. For instance, radiotelephones may incorporate Global Positioning System (GPS) technology or Bluetooth™ wireless technology. GPS is a constellation of spaced-apart satellites that orbit the Earth and make it possible for people with ground receivers to pinpoint their geographic location. Bluetooth technology provides a universal radio interface in the 2.45 GHz frequency band that enables portable electronic devices to connect and communicate wirelessly via short-range ad hoc networks. Radiotelephones incorporating these technologies may require additional antennas tuned for the particular frequencies of GPS and Bluetooth.

Thus, as noted in U.S. patent application Ser. No. 09/193,587, entitled Portable Radiotelephones Including Patch Antennas, to William O. Camp, Jr., assigned to the assignee of the present invention, the disclosure of which is hereby incorporated herein by reference, radiotelephones including GPS receivers have typically used an additional antenna to provide GPS reception. For example, quadrafilar helix antennas extending from the radiotelephone body have been used. The size constraints on these antennas, however, may reduce the gain available using quadrafilar helix antennas. Moreover, these antennas may be oriented at less than ideal angles and/or may be too close to the user's body when used during telephone communications further reducing gain.

Accordingly, there continues to exist a need in the art for improved antennas for GPS receivers incorporated into radiotelephones.

Recently, the Federal Communications Commission (FCC) has promulgated rules requiring that all cell phones be able to transmit their location during a 911 emergency call. As a result, when a user makes an emergency (911) call, the cell phone can be used to precisely determine the user's location and transmit that location as a part of the emergency (911) call. The FCC approach is defined as Enhanced 911 (E911)Call Completion. The FCC requirements for E911 are described in FCC Document No. 94-102 (available at www.fcc.gov/e911/). One way the FCC requirements for E911 may be satisfied is by providing a cell phone with a separate GPS antenna.

In the few cases that a GPS function has been included in a cell phone product, the GPS antenna has typically been a patch antenna. For example, see U.S. patent application Ser. No. 09/193,587, entitled Portable Radiotelephones Including Patch Antennas, to William O. Camp, Jr., wherein a large GPS patch antenna is located on the front face of a cell phone. Although this configuration may enhance isolation, it may also undesirably disable the GPS function when the cell phone is in a normal talk position. Moreover, large patch antennas may be undesirable in today's shrinking cell phones. In addition, externally mounted GPS antennas may be aesthetically undesirable.

A GPS antenna and a primary antenna within a wireless communicator, such as a cell phone, may be in close proximity. Interference and/or coupling between the two antennas may degrade the performance of both antennas. For example, a circuit coupled to one antenna may absorb power coupled to it from the other antenna thereby reducing efficiency of the other antenna. Alternately, a circuit coupled to one antenna may reflect power coupled from the other antenna thereby distorting a radiation pattern for the adjacent antenna.

As such, there is a need for GPS antennas that are small in size, that are inexpensive to manufacture, and that can be isolated from other antennas within a wireless communicator, such as a cell phone.

Notch antennas are well known antenna structures. Notch antennas have a radiation pattern which allows for uniform reception in all directions except for one or more relatively small angular regions where there is a null having a relatively steep slope. Notch antennas may be formed by etching a single side of a unitary metallically clad dielectric sheet or electrodeposited film using conventional photoresist-etching techniques.

FIG. 3A shows a perspective view of a conventional hand-held two way radio shown partially cut away to illustrate the location of a notch antenna. FIG. 3B illustrates a more detailed perspective view of the conventional notch antenna of FIG. 3A. In particular, U.S. Pat. No. 4,723,305 to Phillips et al. discloses an improved antenna configuration for a fully duplex portable radiotelephone that is normally operated in the nearly horizontal position next to the user's ear and mouth. A notch antenna is provided in the bottom portion of the portable radio transceiver parallel to the major longitudinal axis of the housing. Phillips et al. suggest that the notch 80 aperture is cut in the conductive radio housing 78 at a transverse angle to the major face plane of the radiotelephone to form a notch antenna which radiates predominantly vertically polarized E-field waves when the transceiver is positioned such that the major longitudinal axis of the radio is approximately horizontal. U.S. Pat. No.

4,723,305 also discloses that the notch 80 is positioned in the bottom portion 20 of conductive housing 78 such that a plane passing through the notch is perpendicular to the major surface plane of the housing (which is parallel to the X-Y plane). Significantly, the notch 80 is cut in the bottom of the case such that the antenna is located under an operator's hand. The other ends of coaxial cables 86, 88 are attached to radio circuitry 90 as shown.

SUMMARY OF THE INVENTION

In view of the above discussion, notch antennas that can be internally incorporated into wireless communicators and that are functional in a variety of orientations are provided. As used throughout, a "wireless communicator" may refer to analog and digital radiotelephones, multiple mode radiotelephones, high function Personal Communication Systems (PCS) devices that may include large displays, scanners, full size keyboards and the like, and laptop, palmtop and pervasive computing devices that include wireless communications capabilities.

According to first embodiments of the present invention, an antenna for an electronic device includes a printed circuit board (PCB). The PCB has RF circuitry thereon that receives or transmits RF signals. The PCB also has a surface and an elongated configuration that defines a first direction. The PCB includes a ground plane conductor. A notch antenna is formed in the ground plane conductor. The notch is preferably not cut into the dielectric material of the PCB. Integrating the antenna function into the same PCB on which the transmitter and/or receiver functions are also located eliminates the need for an additional antenna component, and as a result may reduce manufacturing costs. It should also be appreciated that by using a notch antenna, the resultant gain coverage volume may be relatively large in comparison to other antenna structures (e.g., a patch antenna). The portion of the PCB underlying the notch is void of conductors, associated with other circuit functions, on all layers of the PCB. For instance, in one embodiment, the notch is simply a narrow rectangular area in which all conductors on all layers of the board have been cleared. This cleared area is free of line traces and components, especially large components such as a speaker and a liquid crystal display. In addition, shielding cans are preferably designed to avoid covering the notch area.

The notch may be formed in the ground plane conductor along a second direction transverse to the first direction. Preferably, the second direction is horizontal when the PCB is oriented such that the first direction is vertical. The notch can be defined by opposite side portions, a closed end, and an open end. For example, the notch could be configured to have opposite side portions that (1) are substantially parallel, (2) have a meandering configuration, (3) have a mirror image configuration, or (4) that have a flared open configuration. A closed end of the notch may have a width greater than the width of the open end of the notch to increase the effective length of the notch.

The notch antenna also includes an RF signal feed electrically connected to each of the side portions of the notch and to the RF circuitry that receives or transmits RF signals. The RF signal feed can be any unbalanced line that is connected to one side portion of the notch and that extends across the notch to the ground plane conductor on the opposite side portion of the notch. For example, the notch may be fed from a microstrip line on one side of the notch connecting across the notch to the ground plane on the opposite side of the notch. Under certain notch configurations the notch may be naturally resonant, and a feed point can be found along the length of the notch that matches the impedance to 50 Ohms (or some other desired impedance) without any additional components. On the other hand, if the notch is not resonant it can be matched to a desired impedance by either dielectrically loading the PCB or by using at least one impedance matching circuit. While the impedance matching circuit could theoretically have many possible configurations, the impedance matching circuit may include at least one of a series capacitor that bridges the notch adjacent the open end and/or at least one shunt capacitor positioned adjacent a side portion of the notch. When RF signals are applied to the side portions via the RF signal feed, and the PCB is oriented such that the first direction is vertical, the notch preferably has a configuration that results in predominantly vertically polarized electromagnetic waves being radiated from the notch in a substantially omnidirectional radiation pattern. If desired, the notch may have approximately the same radiation characteristics as a standard handset monopole without the disadvantage of being an external attachment. Accordingly, antennas according to embodiments of the present invention may eliminate the need for an additional antenna component.

Notch antennas may be provided with various configurations according to additional embodiments of the present invention. For example, antennas according to the present invention may be particularly well suited for use as GPS antennas. Furthermore, because of their compact size, antennas according to the present invention may be easily incorporated within small communications devices. The exemplary notch antenna structure described above could also be implemented in a variety of orientations in a wireless communicator to provide multiple different antenna functions. Moreover, more than one of the above described notch antennas could be implemented simultaneously in a singular wireless communicator to function, for example, as a primary communications antenna and a GPS antenna.

According to another embodiment of the present invention, a wireless communicator is provided that implements the notch antenna described above as a primary communications antenna. The wireless communicator preferably includes a housing, a PCB disposed within the housing, a notch antenna formed within a ground plane within the PCB, and an RF signal feed that electrically connects the notch antenna to RF circuitry on the PCB. The PCB has a surface and an elongated configuration that defines a first direction. The notch is preferably formed in the ground plane along a second direction that is transverse to the first direction.

When a wireless communicator incorporating a notch antenna according to this embodiment of the present invention is oriented such that the first direction is vertical, the notch is configured such that predominantly vertically polarized electromagnetic waves are radiated from the notch in a substantially omnidirectional radiation pattern in response to RF signals. Notch orientation may be important since it may, in part, determine the polarization characteristics of a wireless communicator. For instance, a horizontal orientation of a notch may facilitate vertical polarization, which is highly desirable in, for example, radiotelephones since vertically polarized waves are most easily radiated from a vertically elongated handset. Integrating a notch antenna into a printed circuit board (PCB) may eliminate the need for an additional antenna component.

The opposite side portions of a notch antenna according to the present invention can have a variety of configurations. For example, a notch may be configured to have opposite side portions that (1) are substantially parallel, (2) have a meandering configuration, (3) have a mirror image configuration, or (4) a flared apart configuration. The portion of a PCB underlying a notch is preferably void of conductors associated with other circuit functions on all layers of the PCB. In addition, it is preferable that shield cans not cover a notch of the present invention.

A closed end of the notch may have a width greater than the width of the open end of the notch. The length of a notch antenna preferably does not exceed a quarter wavelength of the lowest frequency of operation. The RF signal feed is electrically connected to each of the notch side portions and to the RF circuitry that receives or transmits RF signals. The RF signal feed can be any unbalanced line that is connected to one side portion of the notch and that extends across the notch to the ground plane conductor on the opposite side portion of the notch.

The position of a notch in a PCB may be important. A notch may be located in a portion of a PCB that is disposed in the upper end portion of the housing, and in a preferred embodiment, the notch is positioned at least 20 mm from the upper end portion of a housing. To maximize bandwidth, a notch may be located in the middle or center of a housing. However, a notch may be preferably located in a position that will not be covered by a user's hand during operation of a device incorporating a notch antenna according to the present invention. Wireless communicators according to other embodiments of the present invention may include at least one impedance matching circuit. Resonance can be achieved artificially by dielectrically loading a PCB or by addition of an impedance matching circuit comprising one or more capacitors. While an impedance matching circuit may be configured in any manner to match impedance of a notch to a desired impedance, an impedance matching circuit may include at least one of a series capacitor that bridges a notch adjacent an open end and a shunt capacitor positioned adjacent a side portion of the notch. Accordingly, a notch antenna according to embodiments of the present invention may be implemented in a wireless communicator as a primary communications antenna.

In other embodiments a notch antenna of the present invention may be implemented as a GPS antenna in a wireless communicator that also includes a primary communications antenna. A notch antenna may be particularly useful when used for GPS reception since the narrow GPS bandwidth may allow the size of the notch to be smaller than the size of a notch when used as a primary antenna. According to this embodiment of the present invention, a GPS notch antenna includes opposite side portions. A GPS signal feed is electrically connected to each of the side portions and to GPS receiver circuitry on the PCB incorporating the notch. According to this embodiment of the wireless communicator, a primary antenna is preferably arranged such that it is polarized orthogonally with respect to the polarization of the GPS notch. In addition, the GPS notch antenna preferably provides a high out-of-band VSWR, which may facilitate good isolation in, for example, cell phone frequency bands. In other words, a GPS notch antenna configured to resonate in a narrow frequency band may help to suppress the coupling to other antennas (i.e., primary communications antennas) outside the GPS band.

According to another embodiment, a GPS notch antenna may be configured such that the notch is polarized in a second polarization direction substantially orthogonal to a first polarization direction. This configuration may be advantageous for a variety of reasons. First, a vertical orientation of the notch makes the polarization nominally orthogonal to that of a primary cell phone antenna. The combination of polarization orthogonality and out-of-band mismatch may provide good isolation across all bands in which coupling could be a problem. To configure the notch specifically for GPS reception, the notch is preferably located in a central portion of a PCB that is disposed adjacent the upper end portion of a housing. As a result, isolation between the primary antenna and the notch may be greater than 20 dB in a frequency band between 500 MHz and 2.5 GHz. Accordingly, a notch antenna according to the present invention may be implemented as a GPS antenna in a wireless communicator which also includes a primary communications antenna.

Other embodiments of the present invention may utilize two or more notch antennas. A first notch may be configured to resonate as an RF antenna within a selected frequency band. A second notch may be configured to resonate within a selected frequency band as a GPS antenna. Accordingly, wireless communicators according to this embodiment of the present invention may implement multiple notch antennas each serving different purposes and performing different functions.

According to another embodiment of the present invention, a surface mount notch antenna is provided. The surface mount notch antenna includes a dielectric substrate, a conductive layer, a notch, and a conductive pattern. The dielectric substrate preferably has opposite first and second surfaces, and opposite edge portions. A conductive layer is disposed on the first surface and a notch is formed in the conductive layer. The notch preferably has opposite sides and an open end. The notch is configured to resonate as an antenna within a selected frequency band. The conductive pattern preferably has a first portion disposed on the second surface, a second portion, and a third portion disposed on the first surface. The first, second, and third portions may be electrically connected. The conductive pattern preferably serves as a feed pad for connecting the surface mount antenna to a feed line. The third portion can be electrically isolated from the conductive layer disposed on the first surface. The conductive pattern is preferably configured to adjust the impedance of the notch. The dielectric substrate may also include at least one ground pad contacting the conductive layer. This ground pad is used for grounding the conductive layer of the surface mount antenna when the antenna is mounted within a wireless communicator.

Depending on the configuration of the notch and the dielectric constant of the dielectric substrate, the notch may or may not resonate naturally. In the case of natural resonance, the impedance of the notch varies monotonically along the length of the notch (i.e., from a relatively high impedance near the open end of the notch to zero at the shorted end). The 50 Ω point may be determined, and the notch may be fed directly without additional components.

If the notch is non-resonant, it may be necessary to provide some additional matching. This may be provided, for instance, by utilizing a capacitive network integrated into the structure of the surface mount component. For example, the conductive pattern, in conjunction with the conductive layer, may preferably comprise at least one capacitor, while the first portion serves as at least one plate of the at least one capacitor. Optionally, the first portion serves as at least one series capacitor plate and at least one shunt capacitor plate. This may provide the required impedance matching.

The second portion may have a variety of configurations. For instance, the second portion may be a conductive via passing through the dielectric substrate, and the first and third portions can be electrically connected by the conductive via. Alternatively, the second portion may be a conductor disposed along an edge portion of the dielectric substrate.

An antenna component according to the present invention may be implemented in a wireless communicator including a housing, a printed circuit board (PCB), a first notch and a plurality of contacts. The PCB includes a ground plane, and has the receiver or transmitter circuitry thereon. The first notch is formed in the ground plane, and includes first opposite side portions and an open end. The surface mount antenna component includes at least one and preferably a plurality of ground pads and at least one signal pad. The ground pads are preferably located on the first dielectric substrate and come in contact with a plurality of contacts connected to the ground plane, and positioned around a periphery of the first notch. These ground pads allow the surface mount antenna component to be grounded thereto. The signal feed pad contacts a feed line to connect the surface mount antenna component to the wireless communicator. A first notch is formed in the ground plane; however, the first notch does not function as the antenna. Instead, the first notch is slightly larger than the second notch. The contacts are preferably located along the opposite side portions of the first notch and facilitate connection to a surface mount antenna component.

According to another embodiment of the present invention, a surface mount antenna is provided that includes a first dielectric substrate, a first conductive layer, a notch, a conductive pattern, a second dielectric substrate and a second conductive layer. The first dielectric substrate has opposite first and second surfaces and opposite edge portions. The first conductive layer is disposed on the first surface. The notch is preferably formed in the first conductive layer, and has opposite sides and an open end. The notch is configured to resonate as an antenna within a selected frequency band.

The conductive pattern has a first portion disposed on the second surface, a second portion, and a third portion disposed on the first surface. The first, second, and third portions are electrically connected, and the third portion is electrically isolated from the conductive layer disposed on the first surface. The second dielectric substrate has opposite third and fourth surfaces. The third surface is disposed in a contacting relationship with the conductive pattern. The second conductive layer is disposed on the fourth surface to capacitively couple the second conductive layer to the first conductive layer. The first dielectric substrate may also include at least one ground pad contacting the first conductive layer. The ground pad is used for grounding the first conductive layer of the surface mount antenna when the antenna is connected to a PCB within a wireless communicator.

The conductive pattern may serve as a feed pad for connecting the surface mount antenna to a feed line. The first and third portions are electrically connected by the second portion. For example, the second portion may be a conductive via passing through the first dielectric substrate. The second portion may be a conductor disposed on an edge portion.

According to additional embodiments of the present invention, notch antenna components may also be provided with multiple dielectric substrate layers to achieve the required values of capacitance. As such antenna components according to the present invention may be useful in a wide variety of wireless communication devices. In addition, various conductor dimensions of these surface mount antenna components may be precisely trimmed with a laser etcher thereby allowing precise control of the frequency of resonance. This may reduce the bandwidth previously required to allow for component tolerances. By reducing the bandwidth required, notch antennas according to the present invention can be small in size.

BRIEF DESCRIPTION OF THE DRAWINGS

FIG. 7A is a side view of a surface mount notch antenna component, according to another aspect of the present invention;

FIG. 7B is a plan view of the bottom of the surface mount notch antenna component shown in FIG. 7A;

FIG. 7C is a plan view of the top of the surface mount notch antenna component shown in FIG. 7A;

FIG. 7D is a plan view of the assembled surface mount notch antenna component shown in FIG. 7A with hidden lines showing the arrangement of conductive layers with respect to each other;

DETAILED DESCRIPTION OF THE INVENTION

Figures 1, 2:
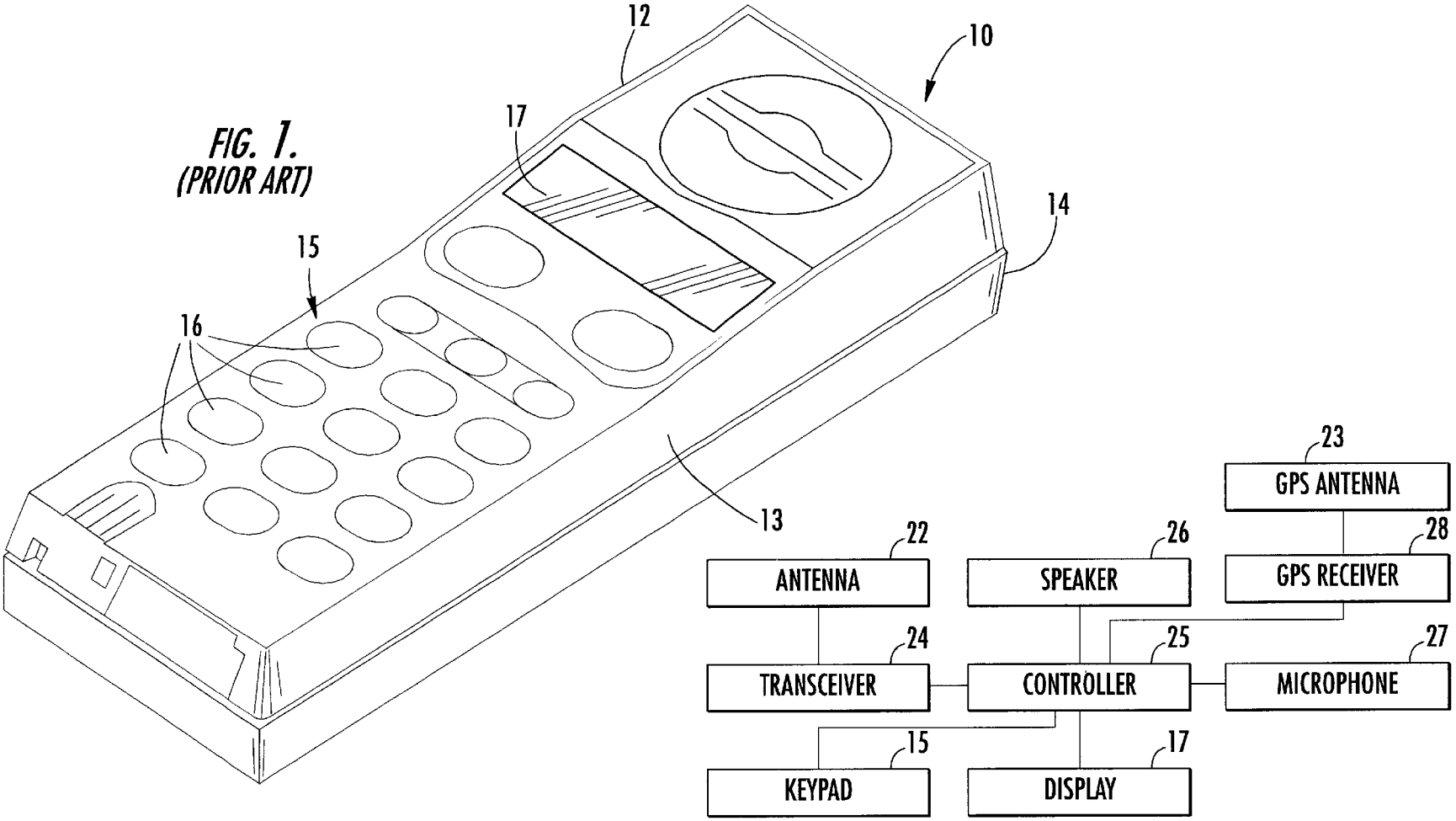
FIG. 1. (PRIOR ART)
FIG. 2. (PRIOR ART)
FIG. 1 is a perspective view of an exemplary radiotelephone within which an antenna according to the present invention may be incorporated.
FIG. 2 is a schematic illustration of a conventional arrangement of electronic components for enabling a radiotelephone to transmit and receive telecommunications signals.
Figure 3A:
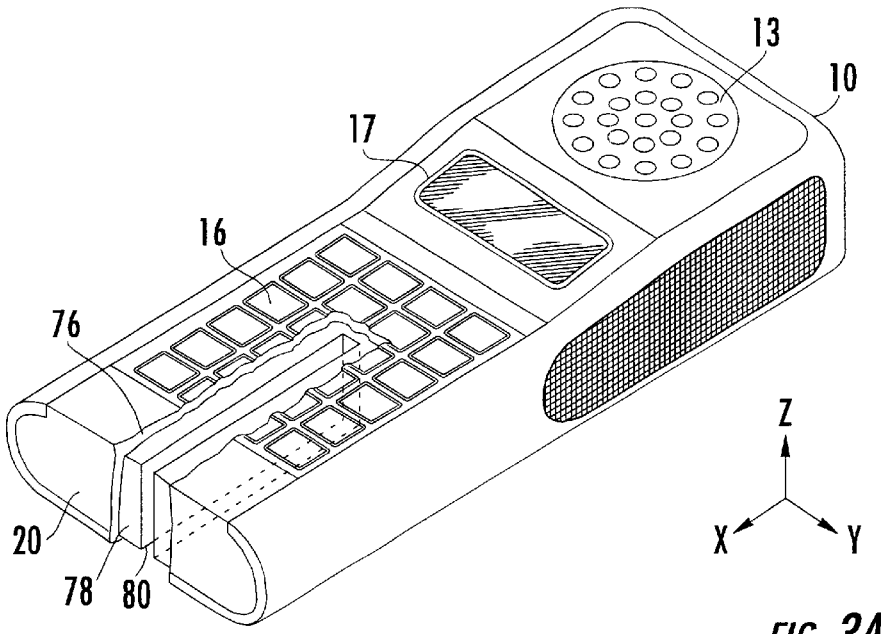
FIG. 3A. (PRIOR ART)
FIG. 3A is a perspective view of a conventional hand-held two way radio shown partially cut away to illustrate the location of a notch antenna.
Figure 3B:
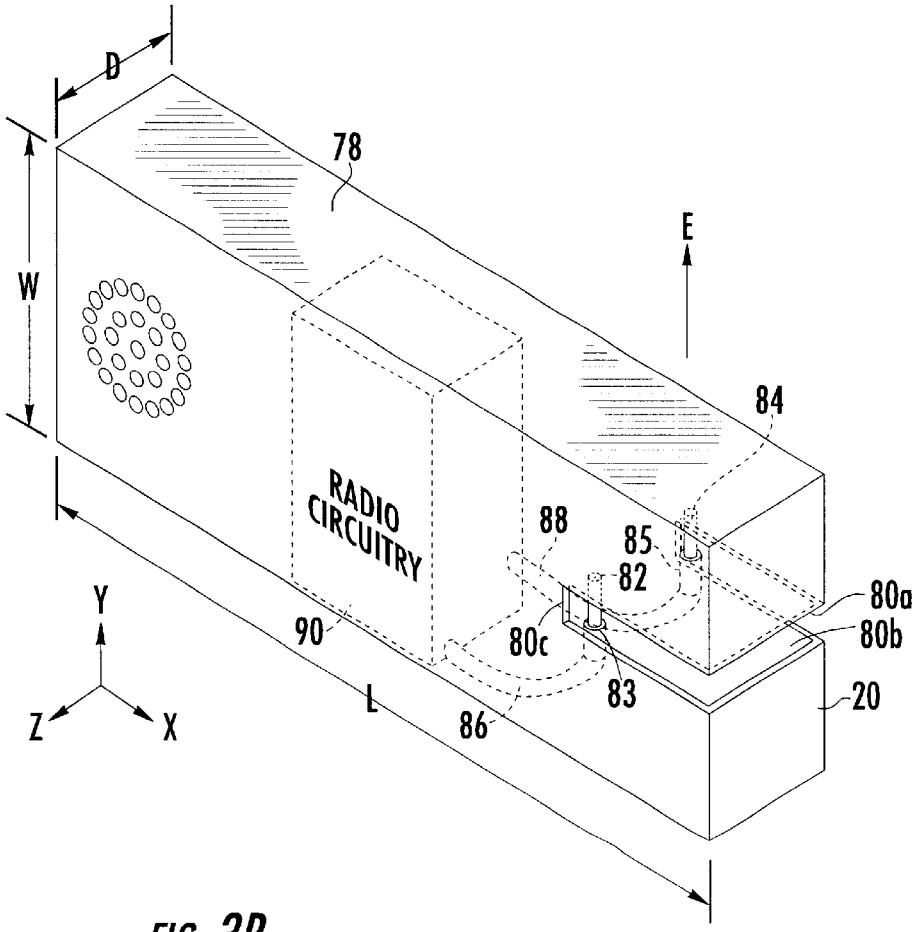
FIG. 3B. (PRIOR ART)
FIG. 3B is a more detailed perspective view of the conventional notch antenna of FIG. 3A.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another element, there are no intervening elements present.

Referring now to FIG. 1, a radiotelephone 10, within which antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

Antenna structures are designed to perform a desired electrical function such as transmitting/receiving linearly polarized, right-hand circularly polarized, left-hand circularly polarized, etc., radio frequency (RF) signals with appropriate gain, bandwidth, beamwidth, minor lobe level, radiation efficiency, aperture efficiency, receiving cross section, radiation resistance and other electrical characteristics.

As is known to those skilled in the art of communications devices, an antenna is a device for transmitting and/or receiving electrical signals. The amount of power radiated from or received by an antenna depends on its effective aperture area and its efficiency and is described in terms of gain.

Radiation patterns for antennas are often plotted using polar coordinates.

Voltage Standing Wave Ratio (VSR) relates to the impedance match of an antenna feed point to a feed line or transmission line of a communications device, such as a radiotelephone. To radiate RF energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components to provide a 50 Ohm (Ω) (or desired) impedance value at the feed point.

Wireless communicators generally utilize an external projecting antenna as a primary communications antenna. Some portable transceiver antennas have been made retractable, while other antennas have been somewhat shorter and fixed.

Figure 4A:
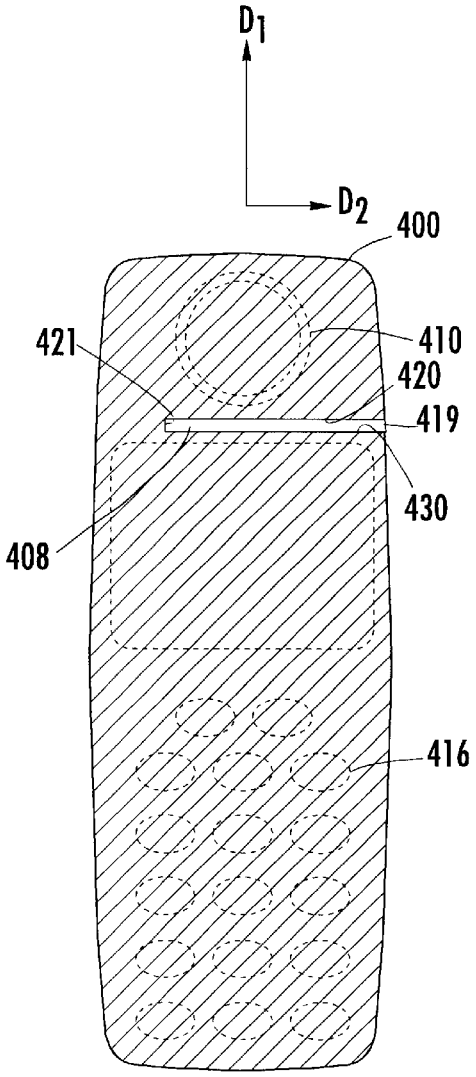
FIG. 4A is a front view of a notch antenna integrated into a ground plane layer of a printed circuit board used in a radiotelephone, according to one embodiment of the present invention.

Referring now to FIG. 4A, a notch antenna 408 according to an embodiment of the present invention is integrated into a ground plane layer 400 of a printed circuit board (PCB) used in a radiotelephone. The notch 408 is configured to serve as the primary antenna of a wireless communicator, and to exhibit substantially the same radiation characteristics as a standard handset monopole.

Figure 4B:
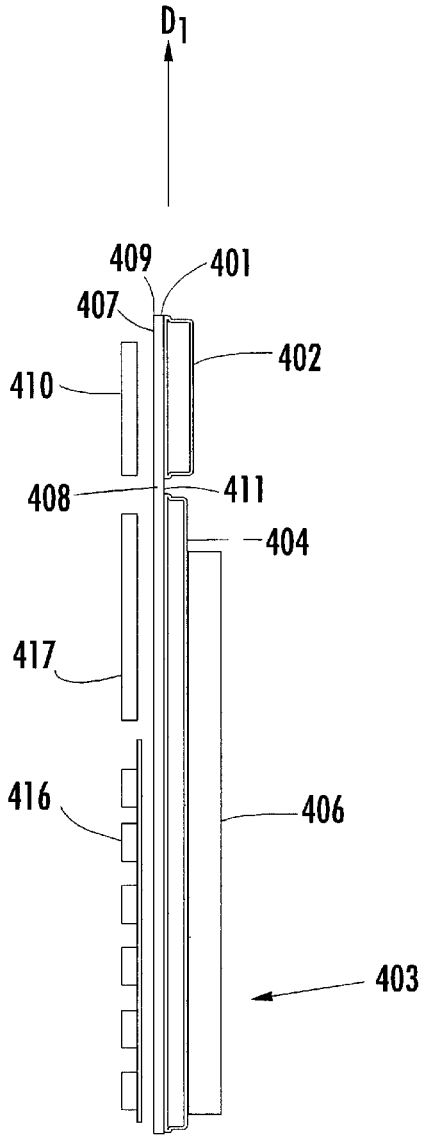
FIG. 4B is a side view of components of a wireless communicator showing the ground plane layer of a printed circuit board as shown in FIG. 4A, according to one embodiment of the present invention.

FIG. 4B shows a side view illustrating how the components of a wireless communicator 403 are arranged with respect to the notch antenna 408. The PCB 401 has transmitter and/or receiver functions located thereon (not illustrated). Preferably, the receiver and transmitter are enclosed by shield can 402. The PCB has digital components thereon which are enclosed by shield can 404. The PCB 401 has a surface 407 and an elongated configuration that defines a first direction D1. Importantly, the notch antenna 408 is formed only in this ground plane conductor 400, and is preferably not cut into the dielectric material 409 of the PCB 401. Integrating the notch antenna 408 function into the same PCB 401 on which the transmitter and/or receiver functions are also located may eliminate the need for an additional antenna component.

The portion 411 of the PCB 401 underlying the notch 408 is preferably void of conductors, associated with other circuit functions, on all layers thereof. As shown in FIG. 4A, the notch 408 may be a narrow rectangular area in which all conductors on all layers of the PCB have been cleared. This cleared area is preferably free of line traces and components, especially large components such as the speaker 410 and the liquid crystal display 417. In addition, all shielding cans 402, 404 also are preferably designed to avoid covering the area of the notch 408.

In designing a notch antenna factors that influence the bandwidth include, but are not necessarily limited to: the length of the notch 408, the contour of the opposite side portions 420, 430 of the notch 408, and the permittivity of the dielectric substrate 409. To help maximize bandwidth, the length of the notch 408 should be as long as possible, up to a quarter wavelength at the lowest frequency of operation. However, the small size of the PCB 401 places certain predetermined constraints on notch 408 length.

Under certain notch 408 configurations the notch 408 may be naturally resonant, and a feed point can be found along the length of the notch 408 that matches the impedance to 50 Ohms (or some other desired impedance) without any additional components. On the other hand, if the notch 408 is not resonant it can be matched to a desired impedance by either dielectrically loading the PCB 401 or by using an impedance matching circuit. That is, since the notch 408 length cannot be a fall quarter wavelength in most cases, resonance can be achieved artificially by the dielectric loading of the PCB 401 and/or by the addition of one or more capacitors (not shown). The impedance matching circuit may include at least one of a series capacitor that bridges the notch 408 adjacent the open end 419 and/or at least one shunt capacitor positioned adjacent a side portion 420, 430 of the notch 408. Nonetheless, excessive loading by either means may significantly reduce bandwidth and increase conductor losses. The width of the notch 408 can be relatively narrow, typically one or two millimeters The notch 408 is defined by opposite side portions 420, 430, a closed end 421, and an open end 419. The opposite side portions can take on a wide variety of arrangements. For example, the notch 408 could be configured to have opposite side portions 420, 430 that (1) are substantially parallel, (2) have a meandering configuration, (3) have a mirror image configuration, or (4) are flared apart from each other towards the open end. These side portions can even include discontinuities. The closed end 421 of the notch 408 may have a width greater than the width of the open end 419 of the notch 408 to increase the effective length of the notch 408.

The printed circuit board 401 includes a ground plane conductor 400. As shown in FIG. 4A, the notch 408 is preferably formed in the ground plane conductor 400 along a second direction D2 transverse to the first direction D1. Moreover, the second direction D2 is preferably horizontal when the PCB is oriented such that the first direction D1 is vertical. Orienting the notch 408 in this manner may facilitate vertical polarization, which is typically employed in wireless communications since vertical polarization is most easily radiated from the vertically elongated shape typically used in wireless communicators.

The antenna may also include an RF signal feed electrically connected to each of the side portions 420, 430 and to the RF circuitry that receives or transmits RF signals that are enclosed by shield can 402. The RF signal feed can be any unbalanced line that is connected to one side portion 420, 430 of the notch 408 and that extends from the notch 408 to the ground plane conductor 400 on the opposite side portion 420, 430 of the notch 408. For example, the notch 408 may be fed from a microstrip line on one side 420, 430 of the notch 408 connecting across the notch 408 to the ground plane 400 on the opposite side of the notch 408. Notch antennas are designed such that when the notch 408 is supplied with RF energy, it creates a field from the notch 408 which, thereby, establishes propagation of the far field radiation. Thus, the polarization of the notch 408 antenna is somewhat analogous to that of a simple dipole antenna in that radiation is launched linearly from the notch 408 with the E-vector component lying in the plane of the printed circuit board 401 and the H-vector component being normal thereto. Stated differently, when RF signals are applied to the side portions 420, 430 via an RF signal feed, and the PCB 401 is oriented such that the first direction D1 is vertical, the notch 408 preferably has a configuration that results in predominantly vertically polarized electromagnetic waves being radiated from the notch 408 in a substantially omnidirectional radiation pattern. Thus, if desired, the notch 408 may have approximately the same radiation characteristics as a standard monopole, without the disadvantage of being an external attachment. Accordingly, antennas according to embodiments of the present invention may eliminate the need for an additional antenna component.

Figure 4C:
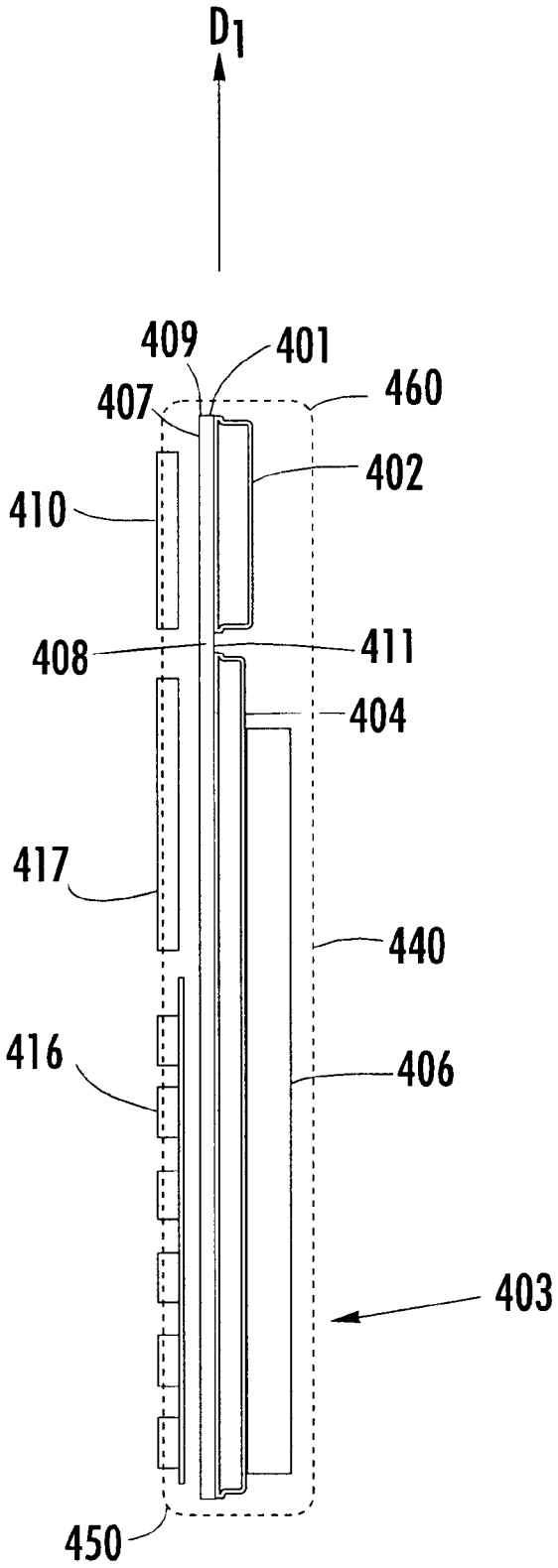
FIG. 4C is a side view showing the antenna of FIGS. 4A and 4B implemented in a radiotelephone.

The embodiments of the notch antenna described above have many potential applications. As mentioned above, embodiments of the notch antenna described above may be implemented as a primary communications antenna in a wireless communicator. For example, FIG. 4C shows other embodiments of the present invention, in which a wireless communicator 403 is provided that includes a housing 440, a printed circuit board (PCB) 401 disposed within the housing 440, a notch 408, and an RF signal feed. The housing 440 is configured to enclose a receiver or transmitter that receives or transmits RF signals. The housing has a lower end portion 450 and an upper end portion 460. The PCB 401 preferably has RF circuitry thereon. The PCB 401 has a surface 407 and an elongated configuration that defines a first direction D1. The PCB 401 also includes a ground plane conductor. As described above in FIG. 4A, the notch 408 is preferably formed in the ground plane conductor 400, and includes opposite side portions 420, 430 and an open end 419. The notch 408 is configured to resonate as an antenna within a selected frequency band. The particular frequency band can be changed by changing the dimensions of the notch, among other things.

The orientation of the notch 408 is important since it will, in part, determine the polarization characteristics of the wireless communicator 403. For instance, a horizontal orientation of the notch 408 will facilitate vertical polarization, which is highly desirable in, for example, radiotelephones since vertically polarized waves are most easily radiated from a vertically elongated handset. As shown in FIG. 4A, the notch 408 is preferably formed in the ground plane conductor 400 along a second direction D2 transverse to the first direction D1. This second direction D2 is preferably horizontal when the PCB is oriented such that the first direction is vertical. Wireless communicators 403 according to this embodiment of the present invention may also be characterized in that when the PCB is oriented such that the first direction D1 is vertical, the side portions 420, 430 of the notch 408 may have a configuration such that predominantly vertically polarized electromagnetic waves are radiated from the notch 408 in a substantially omnidirectional radiation pattern in response to the RF signals. As noted before, integrating the antenna function into the PCB may eliminate the need for an additional antenna component, and as a result the added cost of the notch may be reduced. The notch antenna also provides several other advantages, and is also desirable for aesthetic reasons.

The notch 408 could be configured to have opposite side portions that (1) are substantially parallel, (2) have a meandering configuration, (3) have a mirror image configuration, or (4) a flared configuration. The portion of the PCB 401 underlying the notch 408 is void of conductors, associated with other circuit functions, on all layers thereof. A closed end 421 of the notch 408 may have a width greater than the width of the open end 419 of the notch 408 to increase the effective length of the notch as illustrated (508, 608) in FIGS. 5A and 6A. The RF signal feed is preferably electrically connected to each of the notch side portions 420, 430 and to the RF circuitry that receives or transmits RF signals. Again, the RF signal feed can be any unbalanced line that is connected to one side portion 420, 430 of the notch 408 and that extends across the notch 408 to the ground plane conductor 400 on the opposite side portion 420, 430 of the notch 408.

Notch antennas may be provided with various configurations according to additional embodiments of the present invention. The exemplary notch antenna structure described above could also be implemented in a variety of orientations in a wireless communicator to provide multiple different antenna functions. For example, antennas according to some embodiments of the present invention may be particularly well suited for use as GPS antennas. Moreover, because of their compact size, antennas according to embodiments of the present invention may be easily incorporated within a variety of small communications devices.

Figure 5A:
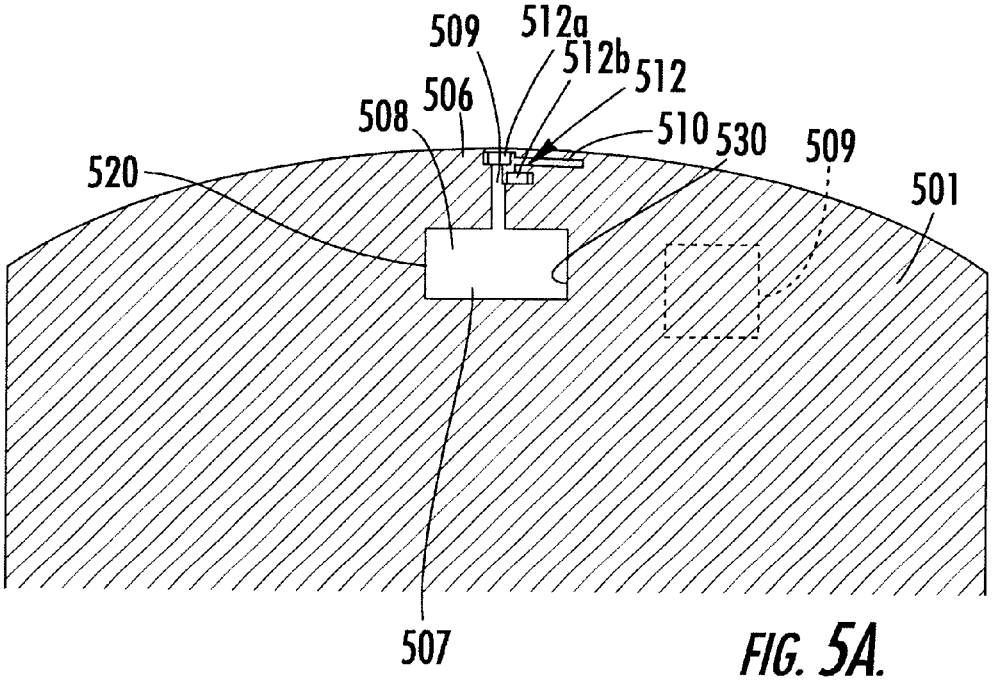
FIG. 5A is a partial plan view of an upper portion of a printed circuit board and shield can assembly shown partially cut away to illustrate the location and shape of a notch antenna in the ground plane conductor, according to an embodiment of the present invention.
Figure 5B:
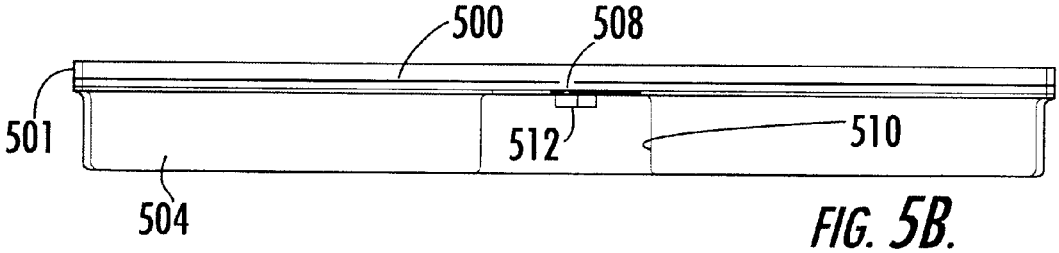
FIG. 5B is an end view of the printed circuit board and shield can assembly as shown in FIG. 5A, further illustrating the location of the notch in the ground plane.

Referring now to FIG. 5A, a plan view of the upper portion of a printed circuit board 501 and shield can assembly illustrates the location and shape of a notch antenna in a ground plane conductor 500 according to another embodiment of the present invention. FIG. 5B shows an end view of the printed circuit board 501 and shield can 504 assembly as shown in FIG. 5A. FIG. 5B further illustrates the location of the notch 508 in the ground plane 500. The notch 508 preferably is utilized as a GPS antenna.

Figure 5C:
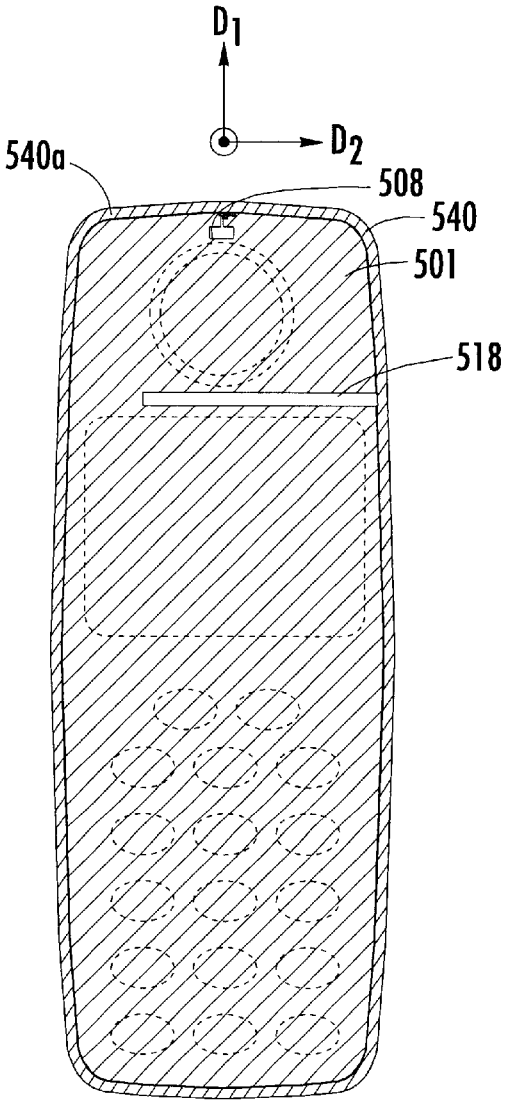
FIG. 5C is a cutaway plan view of the PCB of FIG. 5B in a wireless communicator housing, according to the present invention.
Figure 5D:
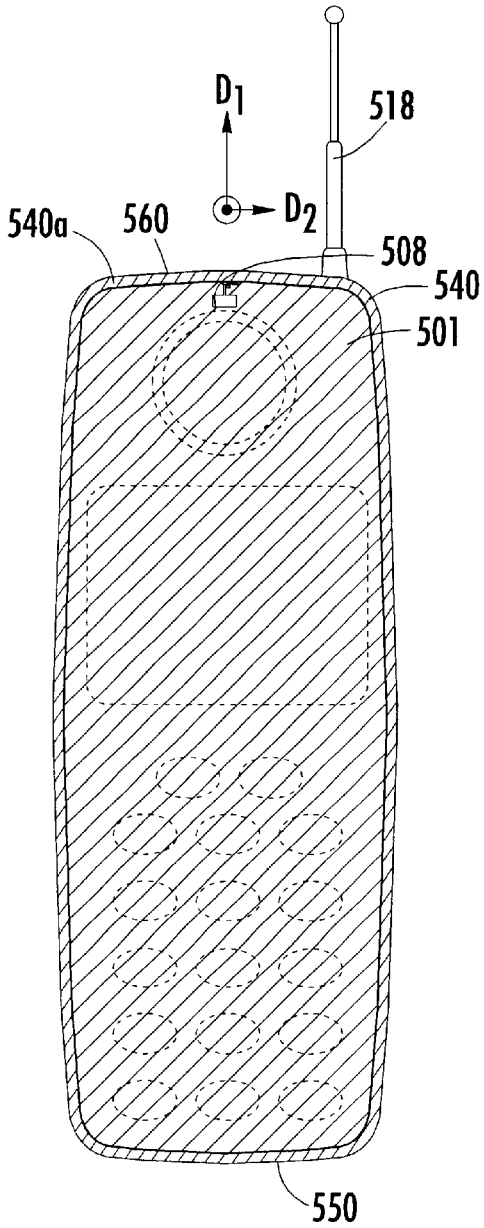
FIG. 5D is a cutaway side view of the PCB of FIG. 5B in a wireless communicator housing, according to the present invention.

FIG. 5C and 5D are cutaway plan views of the PCB of FIGS. 5A–5B disposed within a housing 540 of a wireless communicator. As shown in FIG. 5C and 5D, the housing 540 is configured to enclose primary transceiver circuitry that transmits and receives wireless communications signals. The primary transceiver circuitry can be located anywhere within the housing, and preferably is located on the PCB 501. The housing 540 has a lower end portion 550 and an upper end portion 560. A primary antenna 518 radiates and receives the wireless communications signals.

While the primary antenna 518 in FIG. 5C is also shown as a notch antenna similar to that shown in FIGS. 4A and 4B, one skilled in the art would appreciate that the primary antenna could take may forms, for example, either an external monopole whip, as in FIG. 5D, or an internal planar inverted F antenna (PIFA) could be employed equally as well.

The PCB 501 preferably includes GPS receiver circuitry. The PCB 501 has an elongated configuration that defines a first direction D1. The ground plane conductor 500 is disposed within the PCB 501. The notch 508 may be formed in the ground plane conductor 500 along the first direction D1. The portion of the PCB 501 underlying the notch 508 is preferably void of conductors, associated with other circuit functions, on all layers thereof. In addition, it is preferable that shield cans not cover the notch 508 of the PCB 501.

The notch 508 is preferably located in a portion of the PCB 501 that is disposed in the upper end portion 540A of the housing 540. The particular dimensions of the notch 508 may be varied. For example, a closed end of the notch 508 may have a width greater than the width of the open end of the notch 508. This may increase the effective length of the notch 508 which in turn may increase bandwidth of the notch 508. Typically, the physical length is much less than a quarter wavelength at the lowest frequency of operation. Since a quarter wave electrical length may not be possible without substantial dielectric loading, some notch configurations may not resonate, and therefore a matching circuit may be required to achieve resonance.

Wireless communicators incorporating notch antennas according to the present invention may also, if necessary, include at least one impedance matching circuit. Resonance can be achieved artificially by either dielectrically loading the PCB 501 or by addition of an impedance matching circuit comprising one or more capacitors. While the impedance matching circuit may be configured in any manner to match impedance of the notch 508 to a desired impedance, preferably, the impedance matching circuit includes at least one series capacitor 512*a* that bridges the notch 508 adjacent the open end and a shunt capacitor 512*b* positioned adjacent a side portion of the notch 508. For example, a series capacitor (typically about 0.8 pF) bridging the notch and a shunt capacitor (typically about As shown in FIG. 5A, the notch 508 includes opposite side portions 520, 530 having a linear configuration. However, it is understood that the opposite side portions of the notch 508 can take on a wide variety of configurations. For example, the notch 508 could be configured to have opposite side portions 520, 530 that (1) are substantially parallel, (2) have a meandering configuration, (3) have a mirror image configuration, or (4) a flared apart configuration. The GPS signal feed 510 may be electrically connected to each of the side portions 520, 530 and to the GPS transceiver circuitry 509 that receives the GPS communications signals. The GPS signal feed can be any unbalanced line that is connected to one side portion of the notch and that extends across the notch to the ground plane conductor on the opposite side portion of the notch.

Referring now to FIG. 5C and 5D, the GPS notch 508 preferably provides high out-of-band VSWR, which can allow for good isolation between the primary and GPS notch antennas 518, 508. The notch 508 may be configured such that the notch 508 is polarized in a second polarization direction substantially orthogonal to the first polarization direction. This configuration is advantageous for a variety of reasons. For example, the vertical orientation of the notch 508 makes the polarization nominally orthogonal to that of the primary antenna 518. The combination of polarization orthogonality and out-of-band mismatch provides good isolation across all bands in which coupling could be a problem. While actual measured results depend greatly on the type of primary cell phone antenna used, the isolation that can be achieved between the primary antenna 518 and the notch 508 is preferably greater than 20 dB in a frequency band between 500 MHz and 2.5 GHz.

Figure 5E:
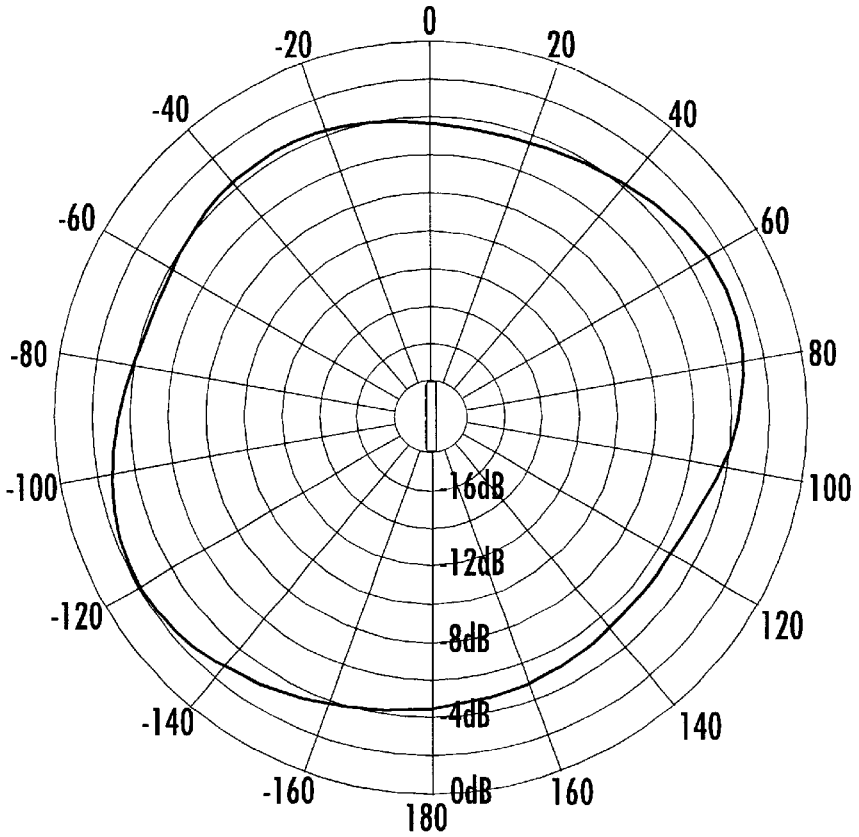
FIG. 5E is a polar plot showing the radiation pattern around the front and back of a wireless communicator implementing the GPS notch antenna shown in FIGS. 5A and 5B, showing the gain of the notch referenced to a right hand circular isotropic level in one of the principal elevation planes.
Figure 5F:
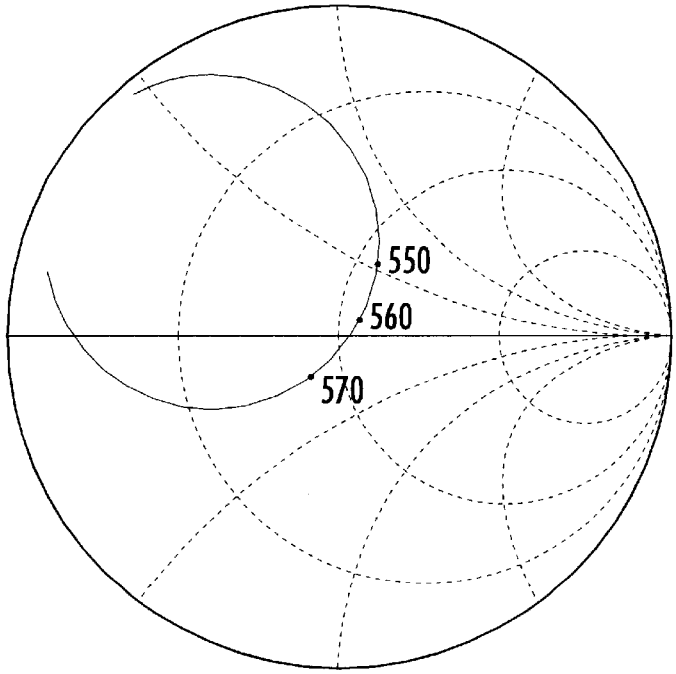
FIG. 5F is a Smith chart illustrating a typical impedance match for the notch antenna of FIGS. 5A and 5B in the GPS band.
Figure 5G:
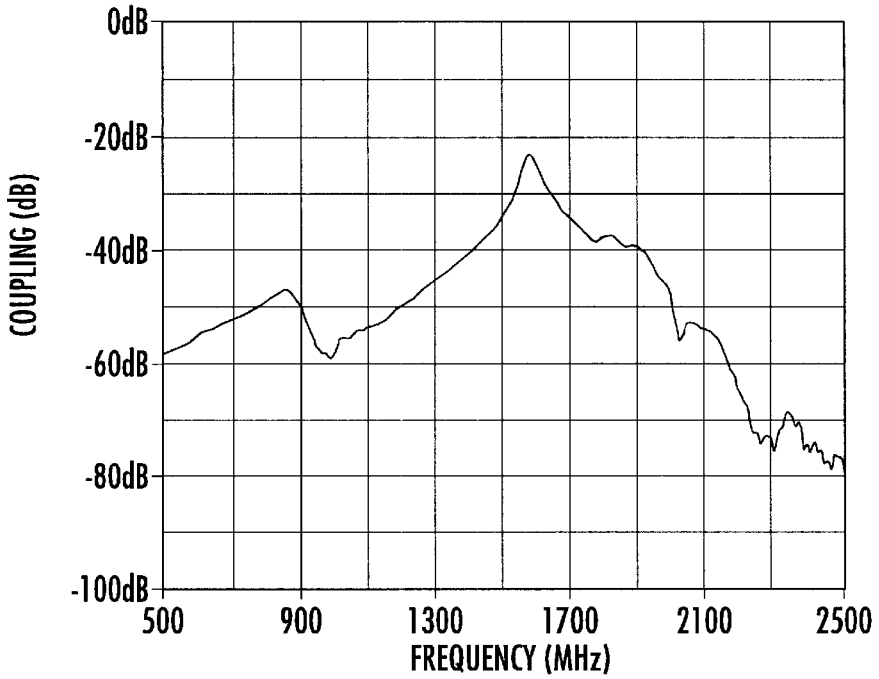
FIG. 5G is a graph showing the isolation between the GPS notch antenna shown in FIGS. 5A and 5B, and a symmetrical planar inverted F antenna (PIFA) when used as the primary antenna.
Figure 5H:
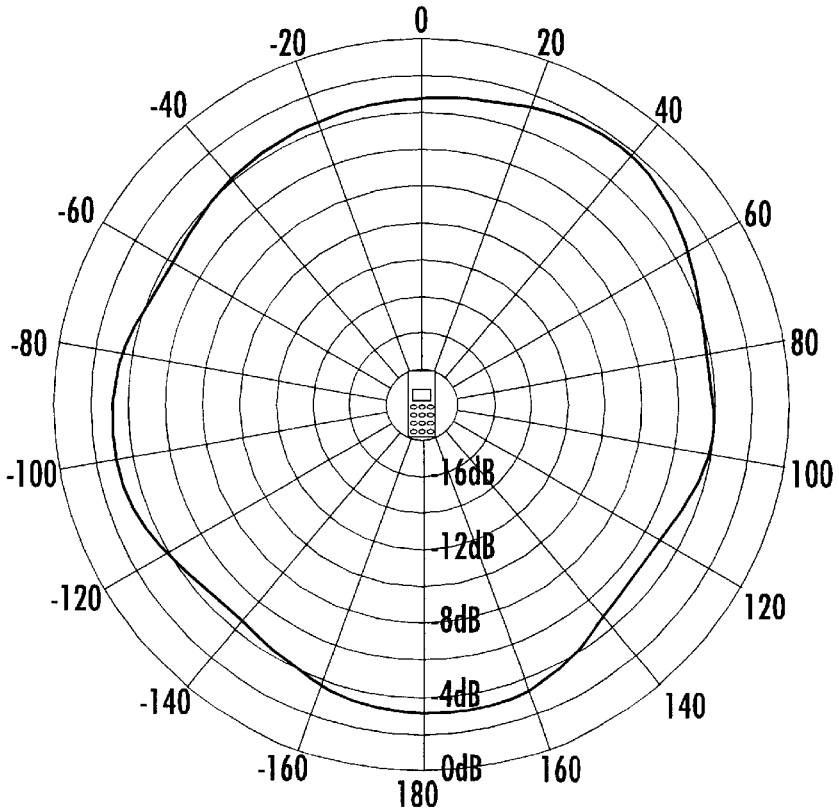
FIG. 5H is a polar plot showing the radiation pattern around the sides of a communicator implementing the GPS notch antenna shown in FIGS. 5A and 5B, showing the gain of the notch referenced to a right hand circular isotropic level in one of the principal elevation planes.

FIG. 5E is a polar plot showing the radiation pattern around the front and back of a wireless communicator implementing the GPS notch antenna 508 shown in FIGS. 5A and 5B, showing the gain of the notch 508 referenced to a right hand circular isotropic level in one of the principal elevation planes. Under certain notch configurations the notch 508 may be naturally resonant, and a feed point for the RF signal feed 510 can be found along the length of the notch 508 that matches the impedance to 50 Ohms (or some other desired impedance) without any additional components. By contrast, FIG. 5F shows a Smith chart illustrating a typical impedance match for the notch antenna 508 of FIGS. 5A and 5B in the GPS band when impedance matching components are used. The marker 560 denotes the center frequency of the GPS band, while markers 550 and 570 are markers for ±5 MHz width. As can be seen from FIG. 5F, the notch antenna 508 is very well matched in the GPS band. FIG. 5G is a graph of showing the isolation between the GPS notch antenna shown in FIGS. 5A and 5B, and a symmetrical planar inverted F antenna (PIFA) when used as the primary antenna. FIG. 5H is a polar plot showing a radiation pattern around the sides of a wireless communicator implementing the GPS notch antenna shown in FIGS. 5A and 5B, and also showing the gain of the notch referenced to a right hand circular isotropic level in one of the principal elevation planes.

Figure 6A:
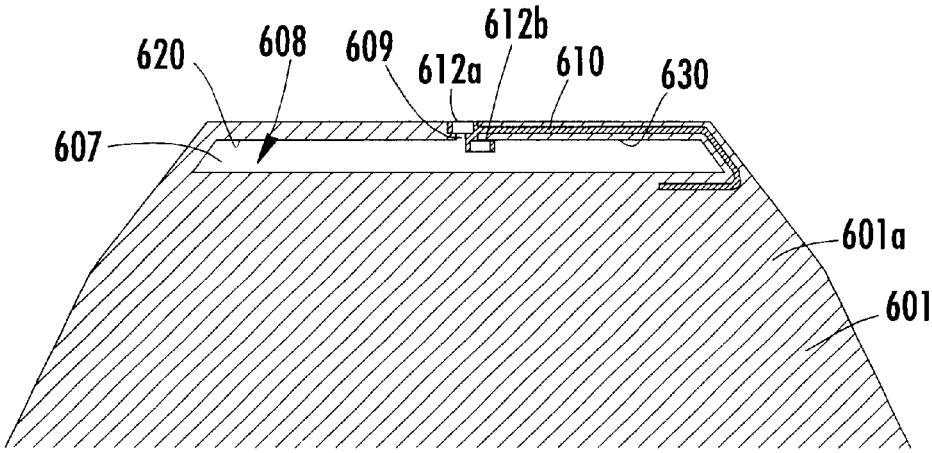
FIG. 6A is a plan view of the upper portion of the printed circuit board and shield can assembly shown partially cut away to illustrate the location and shape of the notch antenna in the ground plane conductor, according to yet another embodiment of the present invention.
Figure 6B:
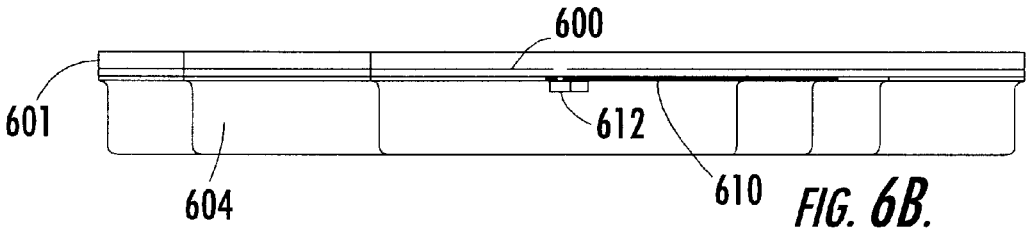
FIG. 6B is an end view of the printed circuit board and shield can assembly as shown in FIG. 6A, further illustrating the location of the notch in the ground plane.
Figure 6C:
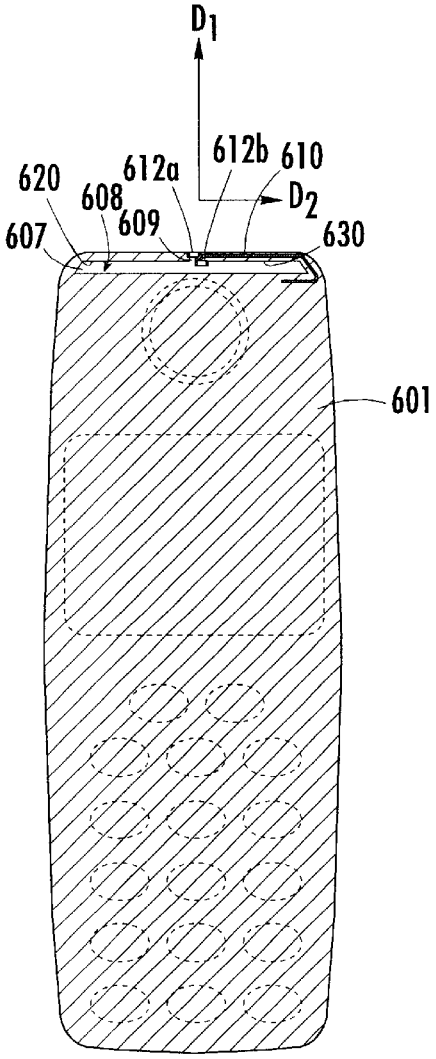
FIG. 6C is a wireless communicator implementing the notch shown in FIGS. 6A and 6B.

The configuration of the notch antenna shown in FIGS. 5A–5C is exemplary only, and the particular dimensions shown are not intended to limit the definition of the present invention. For example, FIGS. 6A–6C show another exemplary notch configuration which is again particularly useful as a GPS notch antenna. FIG. 6A is a partial plan view of the upper portion 601*a* of the printed circuit board 601 and shield can 604 assembly that illustrates the location and shape of a notch 608 antenna in the ground plane conductor 600, according to another embodiment of the present invention. FIG. 6B is an end view of the printed circuit board 601 and shield can 604 assembly as shown in FIG. 6A, further illustrating the location of the notch 608 in the ground plane 600. In contrast, to FIGS. 5A and 5B, the embodiment shown in FIGS. 6A and 6B illustrates that a closed end 607 of the notch may have a width much greater than the width of the open end 609 of the notch. While the present invention encompasses notches of any geometric shape, the notch according to this embodiment is end loaded (ie., enlarged near the lower end of the notch) to better utilize the available ground plane conductor 600 area. This increases the effective length of the notch 608, which in turn may provide increased bandwidth. As noted above, the dimensions shown are simply those of one possible embodiment and are not intended to limit the definition of the invention.

To configure the notch 608 specifically for GPS reception, the notch 608 is preferably located in a central portion of the PCB that is disposed in the upper end portion of the housing. The notch 608 may also be located in a portion of the PCB that is disposed in the upper end portion of the housing.

RF signal feed 610 is electrically connected to each of the side portions 620, 630 and to the RF circuitry (not illustrated). The RF signal feed 610 can be any unbalanced line that is connected to one side portion 630 of the notch 608 and that extends across the notch 608 to the ground plane conductor 600 on the opposite side portion 620 of the notch 608. For example, the notch 608 may be fed from a microstrip line on one side of the notch connecting across the notch to the ground plane on the opposite side of the notch.

If the notch 608 is not resonant, it can be matched to a desired impedance, for instance, by using at least one impedance matching circuit 612*a*, 612*b* as illustrated in FIG. 6A. The impedance matching circuit may induce resonance of the notch 608. The impedance matching circuit 612*a*, 612*b* may be configured from various numbers of combinations of discrete components. Preferably, the impedance matching circuit 612*a*, 612*b* includes at least one capacitor 612*a* that bridges the notch 608 adjacent the open end and a shunt capacitor 612*b* positioned adjacent a side portion 630 of the notch 608.

As shown in FIGS. 5A–5B and 6A–6B, the GPS notch 508, 608 is preferably positioned near the top center of a phone with a vertically oriented notch. Furthermore, because of their small size, antennas according to the present invention may be easily incorporated within small communications devices. As mentioned above, antennas according to the present invention may overcome the need to provide an additional antenna component.

Figure 6D:
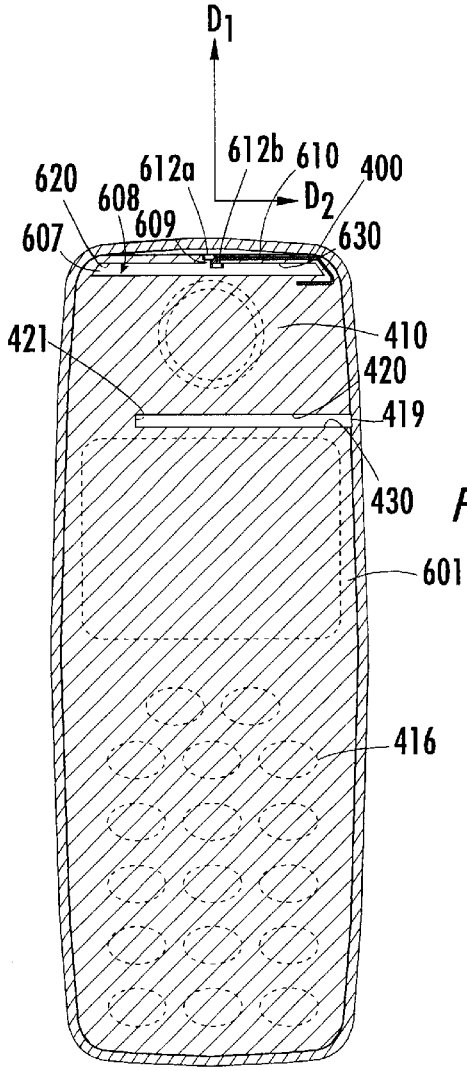
FIG. 6D is a wireless communicator implementing the notch antenna shown in FIGS. 6A and 6B along with a primary antenna as shown in FIG. 4A.

As discussed with respect to FIG. 5C, the notch shown in FIG. 6A may be implemented in a wireless communicator as a GPS antenna, along with a primary antenna, as shown in FIG. 6C and FIG. 6D, respectively.

The exemplary notch antenna structure described above could also be implemented in a variety of orientations to provide multiple different antenna functions. Other embodiments of the present invention may utilize two or more of the notch antennas described above. Therefore, according to other embodiments of the present invention, more than one of the above described notch antennas could be implemented simultaneously in a singular wireless communicator to function, for example as a primary communications antenna and a GPS antenna.

Referring now to FIG. 7A, a side view of a surface mount notch antenna component 700 is shown, according to another embodiment of the present invention. The surface mount antenna 700 includes a dielectric substrate 704, a conductive layer 702, and a conductive pattern 710. FIG. 7D shows a plan view of the assembled surface mount notch antenna component 700 shown in FIG. 7A with hidden lines showing the arrangement of conductive layers with respect to each other. The dielectric substrate 704 preferably has opposite first and second surfaces 719, 720 and opposite edge portions 716*a*, 716*b*. FIG. 7B is a plan view of the first surface 719 of the surface mount notch antenna component 700. A conductive layer 702 is disposed on the first surface 719. The notch 701 is formed in the conductive layer 702. The notch 701 preferably has opposite sides 717, 718 and an open end 703. The notch 701 may be configured to resonate as an antenna within a selected frequency band. The particular frequency band in which the notch 701 resonates may depend upon a variety of factors such as the dimensions of the notch 701. FIG. 7C shows a plan view of the top of the second surface 720 of the surface mount notch antenna component 700 shown in FIG. 7A. The illustrated conductive pattern 710 has a third portion 708 disposed on the first surface 719, a second portion 712, and a first portion 714 disposed on the second surface 720. The third, second, and first portions 708, 712, 714 are electrically connected. The conductive pattern 710 serves as a feed pad for connecting the surface mount antenna 700 to a feed line, as will be discussed below with reference to FIGS. 10A–10C.

The third portion 708 is electrically isolated from the conductive layer 702 disposed on the first surface 719, as illustrated. The dielectric substrate 704 also includes at least one ground pad 706 that contacts the conductive layer. Each ground pad 706 is used for grounding the conductive layer 702 of the surface mount antenna 700 when the antenna 700 is installed on a PCB of a communication device.

If the notch 701 resonates naturally, the notch 701 may be fed directly without additional matching components. The impedance of the notch 701 may vary monotonically along the length of the notch 701 (i.e., from a relatively high impedance near the open end of the notch 701 to zero at the shorted end). Accordingly, the 50 Ω point (or other desired impedance) may be determined depending on the notch 701 configuration. If the notch 701 is non-resonant, it may be necessary to provide a matching network integrated into the structure of the surface mount component 700. For example, the conductive pattern 710, in conjunction with the conductive layer, may preferably comprise a capacitor. The conductive pattern first portion 714 serves as at least one plate of the at least one capacitor and the conductive layer 702 serves as the other plate.

Optionally, the first portion 714 may serve as at least one series capacitor plate 714*b* and at least one shunt capacitor plate 714*a*.

The second portion 712 may have various configurations. For instance, the second portion 712 may include a conductive via passing through the dielectric substrate 704, with the third 708 and first 714 portions electrically connected by the conductive via. Alternatively, as shown in FIG. 7A, the second portion 712 may simply be a conductor disposed along an edge portion 716*b*. The surface mount antenna component 700 of FIGS. 7A–7D may have various configurations, and is not limited to the illustrated configuration.

Figure 8E:
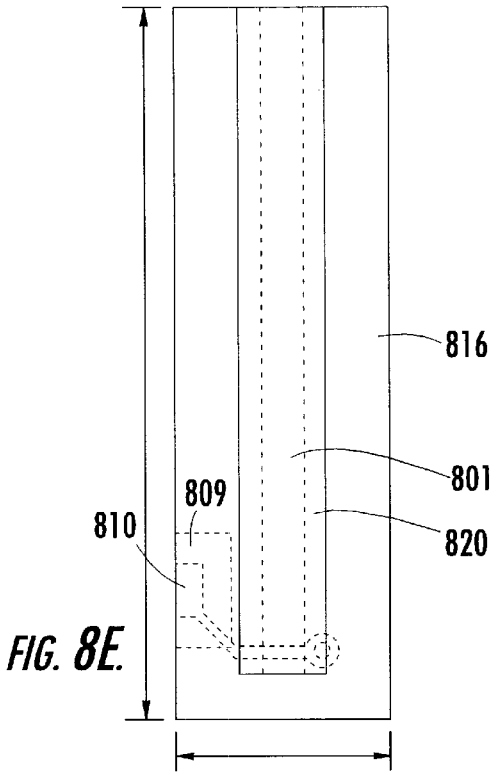
FIG. 8E is a plan view of the assembled surface mount notch antenna component shown in FIG. 8A with hidden lines showing the arrangement of conductive layers with respect to each other.
Figure 8A:
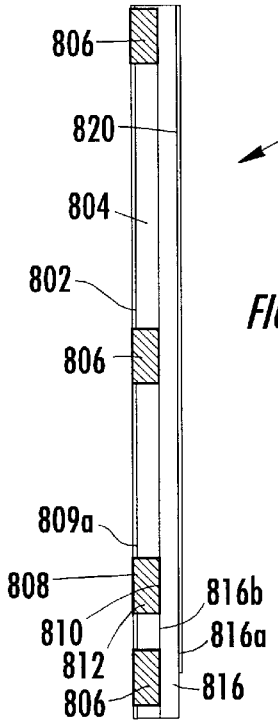
FIG. 8A is a side view of a surface mount notch antenna component, having first and second dielectric substrates, according to another embodiment of the present invention.

Referring now to FIG. 8A–8E, a surface mount notch antenna component 800, according to another embodiment of the present invention is illustrated. Shown in FIG. 8A is a surface mount antenna 800 that includes a first dielectric substrate 804, a first conductive layer 802, a notch 801 (FIG. 8B), a conductive pattern 810, a second dielectric substrate 816, and a second conductive layer 820.

Figure 8B:
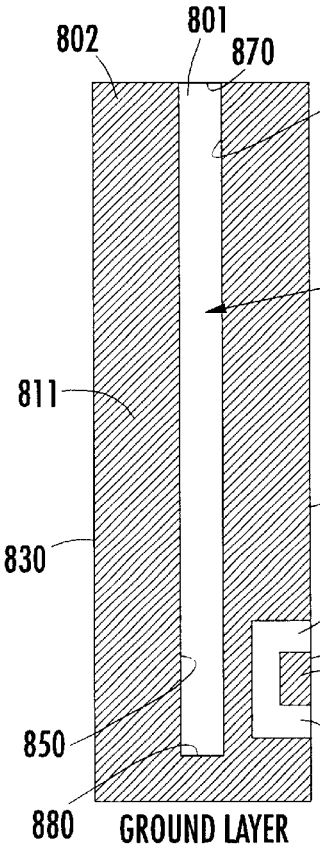
FIG. 8B is a plan view of the bottom of a first dielectric substrate having a conductive layer formed thereon, according to the surface mount notch antenna component shown in FIG. 8A.

Referring now to FIG. 8B, shown is a plan view of a bottom surface of a first dielectric substrate 804 having a conductive layer 802 formed thereon, according to the surface mount notch antenna component 800 shown in FIG. 8A. The first dielectric substrate 804 may have opposite first 804*a* and second 804*b* surfaces and opposite edge portions 830, 840. The first conductive layer 802 can be disposed on the first surface 804*a*. The notch 801 is preferably formed in the first conductive layer 802, and has opposite sides 850, 860 and an open end 870. The notch 801 can be configured to resonate as an antenna within a selected frequency band. For example, the notch could be configured to resonate in the GPS frequency band.

Figure 8C:
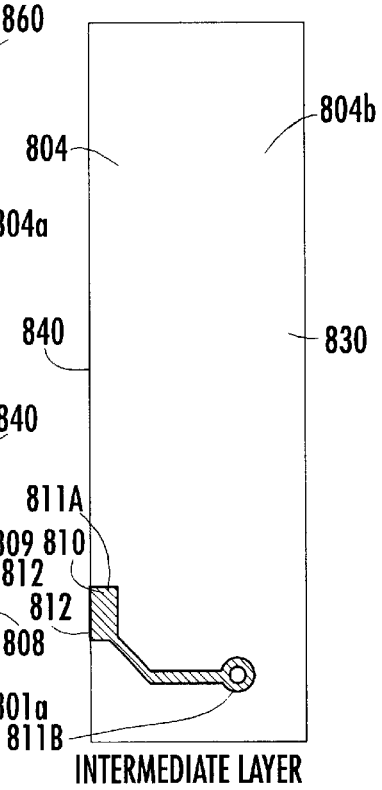
FIG. 8C is a plan view of a top surface of the first dielectric substrate of FIG. 8B having a conductive layer formed thereon.
Figure 8D:
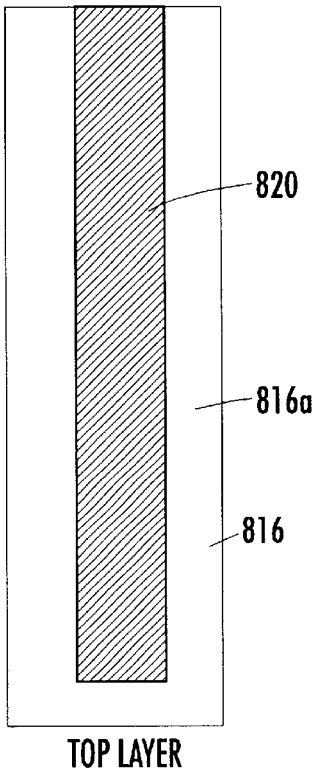
FIG. 8D is a plan view of a top of the second dielectric substrate having a conductive layer formed thereon, according to the surface mount notch antenna component shown in FIG. 8A.

FIG. 8C shows a plan view of the top surface of the second dielectric substrate 804 having a conductive pattern 810 formed thereon, according to the surface mount notch antenna component 800 shown in FIG. 8A. The conductive pattern 810 can have a first portion 811*a* disposed on the second surface 804*b*, a second portion 812, and a third portion 808 disposed on the first surface 804*a*. The first, second, and third portions are electrically connected, and the third portion 808 is preferably electrically isolated from the conductive layer 802 disposed on the first surface 804*a*. The conductive pattern 810 may also include a conductive via 811*b* for the purpose of connecting the feed across the notch 801 to the first conductive layer 802 on the side of the notch 850. FIG. 8D shows a plan view of the top of the first dielectric substrate 816 having a conductive layer 820 formed thereon, according to the surface mount notch antenna component 800 shown in FIG. 8A. The second dielectric substrate 816 has opposite third 816*b* and fourth 816*a* surfaces. The third surface 816*b* can be disposed in a contacting relationship with the conductive pattern 810.

The second conductive layer 820 is preferably disposed on the fourth surface 816*a* to increase the capacitance between opposite sides of the notch 850, 860. The first dielectric substrate 804 may also include at least one ground pad 806 contacting the first conductive layer 802. As will be discussed in detail below, ground pad 806 is used for grounding the first conductive layer 802 of the surface mount antenna 800 when the antenna is installed on a PCB in a communications device. The conductive pattern 810 may serve as a feed pad 808 for connecting the surface mount antenna 800 to a feed line (also discussed in detail below). The first 811*a* and third 808 portions are electrically connected by the second portion 812. For example, the second portion 812 may be a conductive via passing through the first dielectric substrate. By contrast, the second portion 812 may be a conductor 812 disposed on an edge portion 840.

As shown in FIG. 8D, the second conductive layer 820 may be a capacitive strip 820 overlying the notch 801. The capacitive strip 820 serves as at least one plate of a capacitor to increase capacitance along the length of the notch 801, thereby allowing the notch to be resonant. Thus, the notch 801 may be fed directly without any matching components.

Since the impedance of the notch 801 varies monotonically along the length of the notch (i.e., from a relatively high impedance near the open end of the notch to zero at the shorted end), the 50 Ω point may vary depending on the details of the design.

FIG. 8E shows a plan view of the assembled surface mount notch antenna component 800 shown in FIG. 8A with hidden lines showing the arrangement of conductive layers 802, 812, 820 with respect to each other.

Figure 9A:
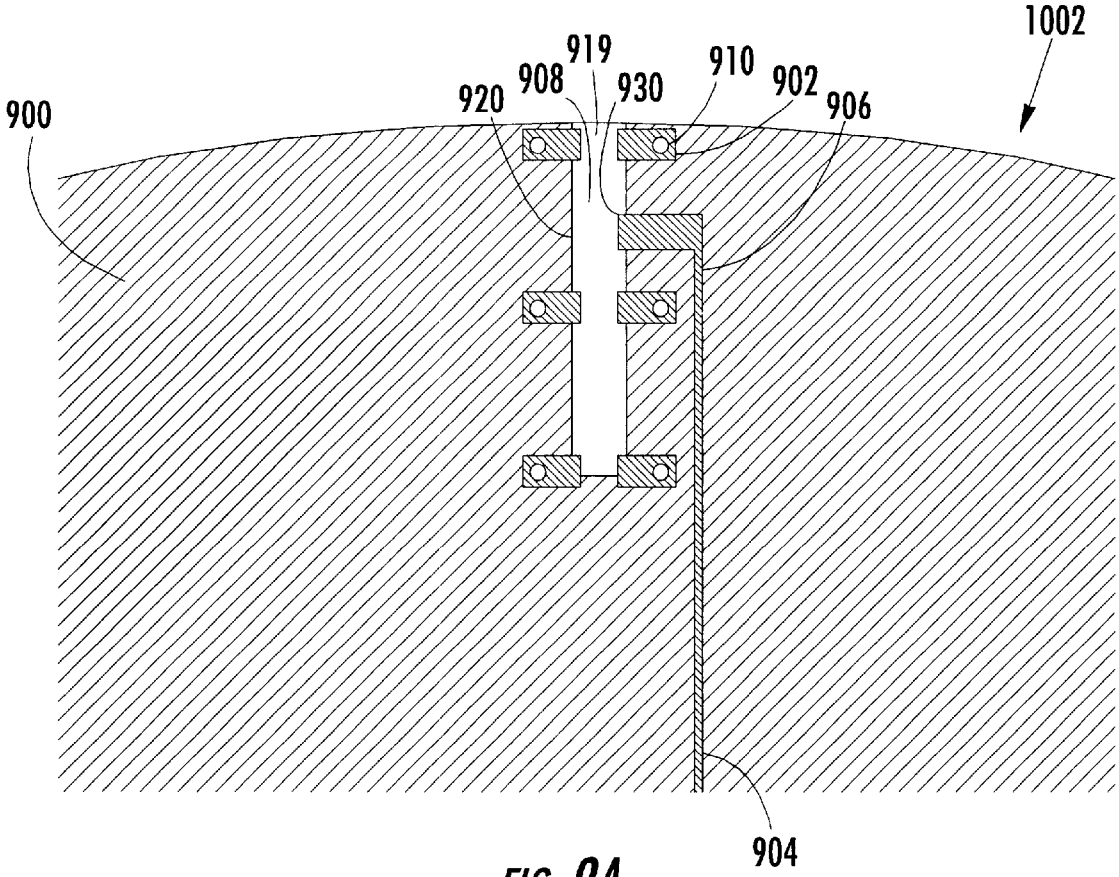
FIG. 9A is a partial plan view of the ground plane of a printed circuit board showing a footprint upon which the assembled surface mount notch antenna components shown in FIG. 7A is mounted.

Referring now to FIG. 9A, shown is a partial plan view of the ground plane 900 of a PCB 1002 having a footprint upon which the assembled surface mount notch antenna component 700 of FIGS. 7A can be mounted. The PCB 1002 includes a ground plane 900, and has receiver and/or transmitter circuitry thereon. A first notch 908 is formed in the ground plane 900, and includes opposite side portions 920, 930 and an open end 919. The first notch 908 is formed in the ground plane 900. However, in this embodiment, the first notch 908 does not function as an antenna. Instead, the dimensions of the first notch 908 are slightly larger than the dimensions of the second notch (discussed below). The plurality of contacts 902 connect to the ground plane 900 adjacent the opposite side portions 920, 930 as illustrated. The plurality of contacts 902 (one or more) are preferably located along the periphery of the first notch 908 to facilitate connection to a surface mount antenna component 700. These contacts 902 facilitate connection to ground pads 706 on or within the surface mount antenna 700. The surface mount antenna component 700 is responsive to receiver and/or transmitter signals, and is mounted on the plurality of contacts 902. An RF signal feed 904, a microstrip feed line for example, may also be included in the PCB 1002 for electrical connection to the conductive pattern 710.

Figure 10A:
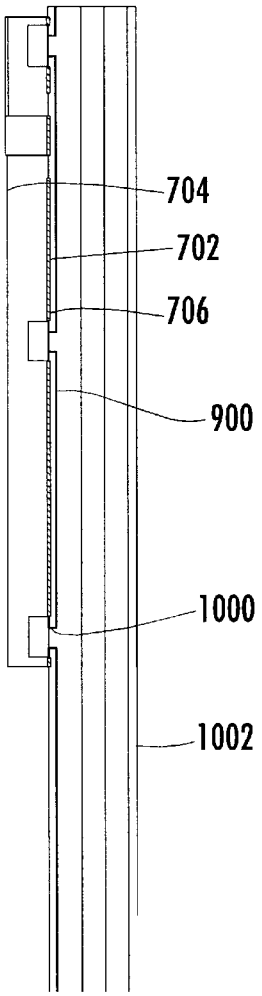
FIG. 10A is a side cross-sectional view of the surface mount notch antenna component shown in FIG. 7A and 7D mounted upon the footprint shown in FIG. 9A and above the ground plane of a printed circuit board.
Figure 10B:
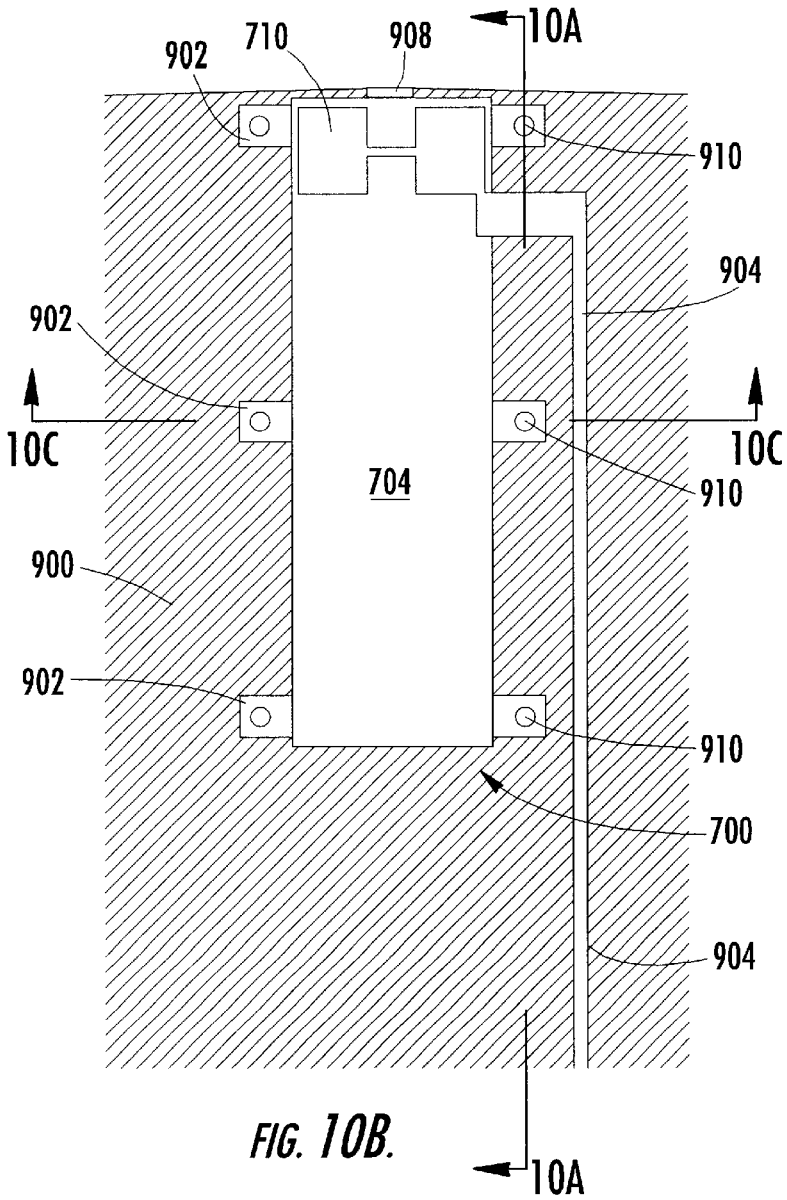
FIG. 10B is a plan view of the surface mount notch antenna component shown in FIG. 7A and 7D mounted upon the footprint shown in FIG. 9A and above the ground plane of a printed circuit board.
Figure 10C:
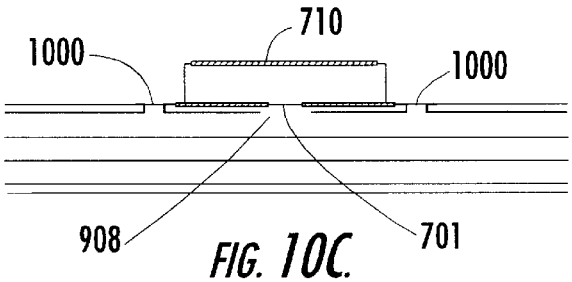
FIG. 10C is an end cross-sectional view of the surface mount notch antenna component shown in FIG. 7A and 7D mounted upon the footprint shown in FIG. 9A and above the ground plane of a printed circuit board.

Referring now to FIG. 10A, shown is a side cross-sectional view of the surface mount notch antenna component shown in FIG. 7A and 7D mounted upon the footprint shown in FIG. 9A and above the ground plane 900 of a printed circuit board 1002. FIG. 10B shows a plan view of the surface mount notch antenna component 700 mounted upon the footprint, and above the ground plane 900 of a printed circuit board 1002. FIG. 10C shows an end cross-sectional view of the surface mount notch antenna component 700 mounted upon the footprint, and above the ground plane 900 of a printed circuit board 1002. These embodiments will now be discussed in detail.

For example, the antenna component described above may be implemented in a wireless communicator including a PCB 1002, a first notch 908 and at least one contact 902. A housing of the wireless communicator may be configured to enclose receiver or transmitter circuitry that receives or transmits wireless communications signals. The PCB 1002 includes a ground plane 900, and has the receiver or transmitter circuitry thereon. The first notch 908 is formed in the ground plane 900, and includes first opposite side portions 920, 930 and an open end 919. The surface mount antenna component 700 includes at least one ground pad 706 and at least one signal feed pad 708. The ground pads 706 are preferably located on the first dielectric substrate 704 and come in contact with corresponding contacts 902 connected to the ground plane 900, adjacent the opposite side portions 920, 930. These ground pads 706 allow the surface mount antenna component 700 to be grounded. Similarly, the at least one signal feed pad 708 contacts a feed line 904 to connect the surface mount antenna component 700 to the wireless communicator. Similar to the embodiment of FIG. 5A, there is still a first notch 908 formed in the ground plane 900. However, in this embodiment the first notch 908 does not function as the antenna. Instead, the dimensions of the first notch 908 are made rectangular and slightly larger than the dimensions of the second notch which functions as the antenna (discussed below).

Contacts 902 may be superposed above the ground plane 900 and adjacent the opposite side portions 920, 930. Contacts 902 (at least one) are preferably located along the opposite side portions 920, 930 of the first notch 908 facilitate connection to a surface mount antenna component 700. Contacts 902 facilitate connection to a conductive layer on or within the surface mount antenna 700. The surface mount antenna component 700 is responsive to the receiver or transmitter signals, and is mounted on the at least one contact 902. The surface mount antenna component 700 includes a dielectric substrate 704, a conductive layer 702, a second notch 701, and a conductive pattern 710. The dielectric substrate 704 may have opposite first and second surfaces 719 and 720, respectively, and opposite edge portions 716*a* and 716*b*. The conductive layer 702 may be disposed on the first surface 719. The second notch 701 may be formed in the conductive layer 702. The second notch 701 has second opposite sides 717, 718 and a second open end 703, configured to resonate as an antenna within a selected frequency band. In contrast to the first embodiment, it is the second notch 701 that actually radiates in this embodiment. The conductive pattern 710 may have a third portion 708 disposed on the first surface 719, a second portion 712, and a first portion 714 disposed on the second surface 720. The first portion 714, second portion 712, and third portion 708 are preferably electrically connected. The conductive pattern 710 serves a variety of functions, one of which is that of a feed pad for connecting the surface mount antenna to a feed line. The third portion 708 may also be electrically isolated from the conductive layer disposed on the first surface 719. As discussed above, the conductive pattern 710 can be configured to adjust the impedance of the notch 710, however, for sake of brevity, that discussion will not be repeated here. The RF signal feed 904 is electrically connected to the conductive pattern.

Figure 9B:
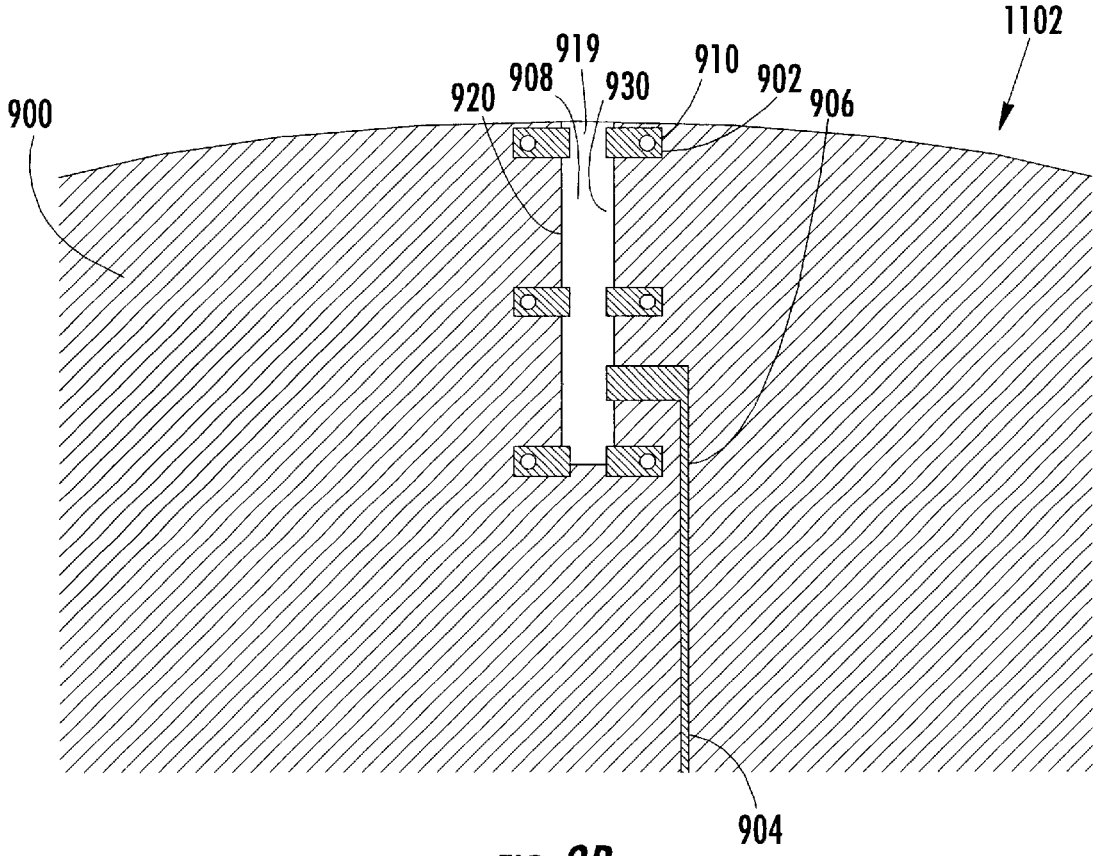
FIG. 9B is a partial plan view of the ground plane of a printed circuit board showing a footprint upon which the assembled surface mount notch antenna components shown in FIG. 8A are mounted.
Figure 11A:
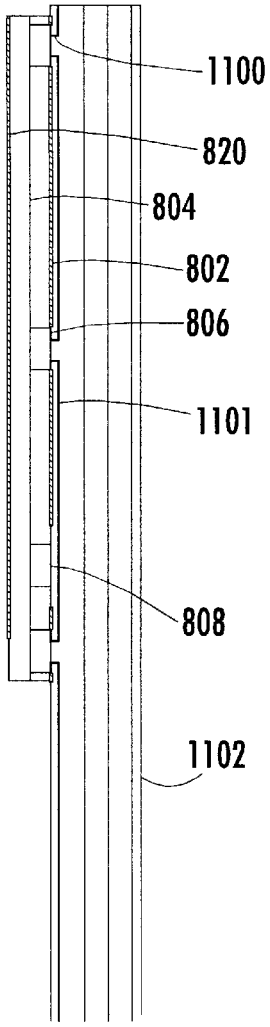
FIG. 11A is a side cross-sectional view of the surface mount notch antenna component shown in FIG. 8A and 8E mounted upon the footprint shown in FIG. 9B and above the ground plane of a printed circuit board.
Figure 11B:
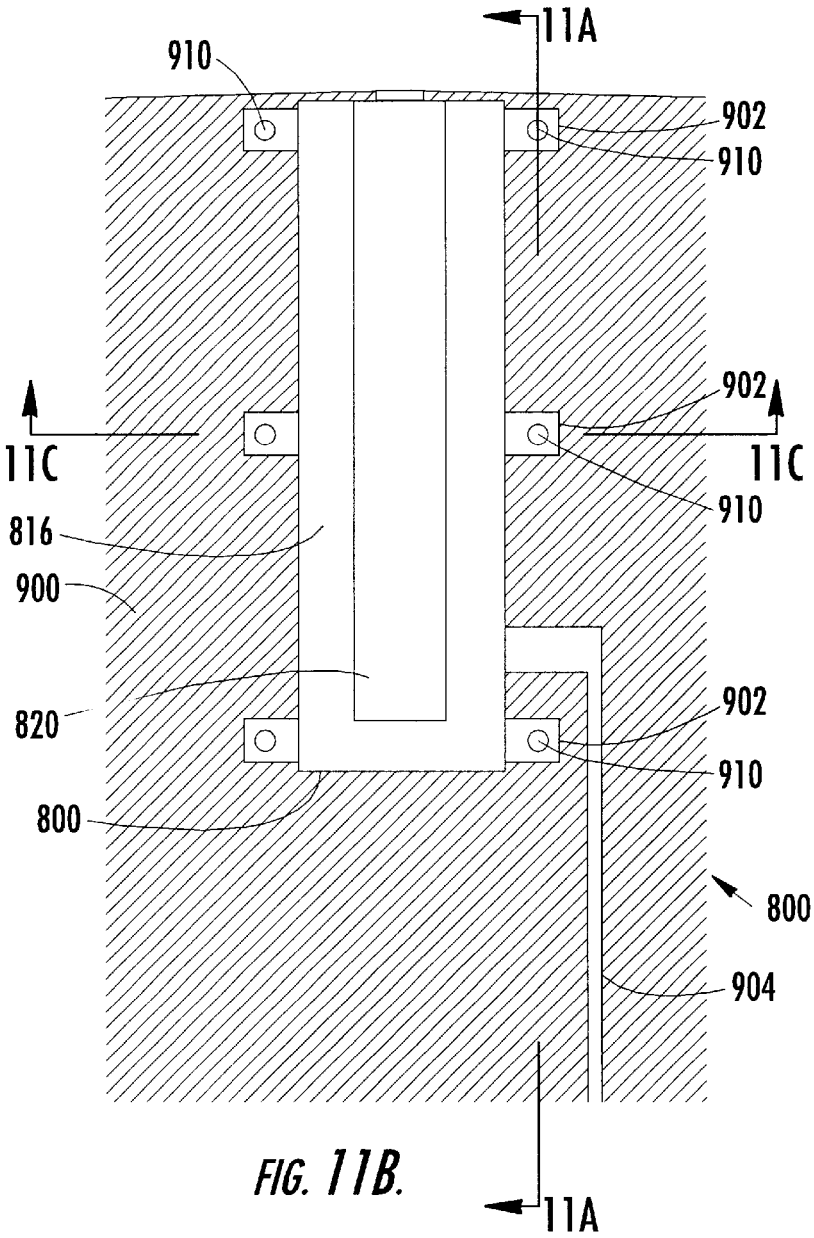
FIG. 11B is a top view of the surface mount notch antenna component shown in FIG. 8A and 8E mounted upon the footprint shown in FIG. 9B and above the ground plane of a printed circuit board.
Figure 11C:
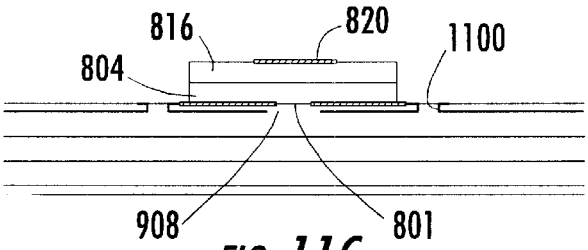
FIG. 11C is an end cross-sectional view of the surface mount notch antenna component shown in FIG. 8A and 8E mounted upon the footprint shown in FIG. 9B and above the ground plane of a printed circuit board.

The surface mount antenna shown in FIGS. 8A–8D may also be implemented in a wireless communicator. Referring now to FIG. 11A, shown is a side cross-sectional view of the surface mount notch antenna component shown in FIGS. 8A and 8D mounted upon the footprint shown in FIG. 9B and above the ground plane 900 of a PCB 1102. FIG. 11B shows a top view of the surface mount notch antenna component 800 mounted upon the footprint, and above the ground plane 900 of a PCB 1102 FIG. 11C shows an end cross-sectional view of the surface mount notch antenna component 800 mounted upon the footprint, and above the ground plane 900 of a PCB 1102. These figures will now be discussed in detail.

The PCB 1102 includes a ground plane 900, and has the receiver and/or transmitter circuitry thereon. The first notch 908 is formed in the ground plane 900, and includes first opposite side portions 920, 930 and an open end 919. Once again, the first notch 908 is still in the ground plane 900, however the first notch 908 does not function as the antenna. Instead, the dimensions of the first notch 908 are slightly larger than the dimensions of the second notch (discussed below). As before, the plurality of contacts 902 may extend above the ground plane 900 and adjacent the opposite side portions 920, 930. The plurality of contacts 902 (at least one, preferably four or more) are again preferably located along the opposite side portions 920, 930 of the first notch 908 to facilitate connection to a surface mount antenna component 800. These contacts 902 facilitate connection to ground pads 806 on the surface mount antenna. The surface mount antenna component 800 is responsive to the receiver or transmitter signals, and is mounted on the plurality of contacts 902. An RF signal feed 904, a microstrip feed line for example, may also be included in the PCB for electrical connection to the conductive pattern.

The surface mount antenna component includes a plurality of ground pads 806 and at least one signal feed pad 808. The ground pads 806 are preferably located on the first dielectric substrate and come in contact with the plurality of contacts 902 connected to the ground plane, adjacent the opposite side portions. These ground pads 806 allow the surface mount antenna component 800 to be grounded when the ground pads connect to the contacts at the edge of the notch to connect the surface mount antenna component to the ground plane on or within the PCB. Similarly, the at least one signal feed pad 808 contacts a feed line 904 to connect the surface mount antenna component 800 to the wireless communicator. The surface mount antenna component 800 includes a first dielectric substrate 804, a first conductive layer, a second notch 801, a conductive pattern 810, a second dielectric substrate 816 and a second conductive layer 820. The first dielectric substrate 804 may have opposite first 804*a* and second 804*b* surfaces and opposite edge portions 830, 840. The first conductive layer 802 may be disposed on the first surface 804*a*. The second notch 801 may be formed in the first conductive layer 802. The second notch 801 has second opposite sides 850, 860 and a second open end 870. The second notch 801 is configured to resonate as an antenna within a selected frequency band. The second notch 801 is smaller than the first notch 908. The conductive pattern 812 may have a first portion 810 disposed on the second surface 804*b*, a second portion, and a third portion disposed on the first surface. The first, second, and third portions are preferably electrically connected. The third portion may also be electrically isolated from the conductive layer 802 disposed on the first surface 804*a*. The second dielectric substrate 816 may have opposite third 816*b* and fourth 816*a* surfaces. The third surface 816*b* is preferably disposed in contacting relationship with the conductive pattern 812. The second conductive layer 820 is disposed on the fourth surface 816*a* to increase the capacitance between opposite sides of the notch 850, 860. The RF signal feed 904 is electrically connected to the third portion 808.

In view of the above discussion, the present invention can provide small, low cost, notch antennas for wireless communicators that can be internally incorporated into the existing structure of wireless communicators and that can be functional in a variety of orientations.

According to additional embodiments of the present invention, notch antenna components may also be provided with multiple dielectric substrate layers to achieve the required values of capacitance. As such antenna components according to the present invention may be useful in a wide variety of wireless communication devices.

In addition, one advantage of implementing notch antennas in a surface mount chip according to the present invention is that various conductor dimensions may be precisely trimmed with a laser etcher thereby allowing precise control of the frequency of resonance. For example, the length of a notch, the size of a capacitive strip, or the size of a series capacitor plate, may be easily adjusted, thereby changing the frequency of resonance. Such precise control may significantly reduce the dependency on component tolerances, thereby reducing the bandwidth required to allow for these tolerances. By reducing the bandwidth required, notch antennas can be made smaller than conventional GPS antennas.

It is to be understood that the present invention is not limited to the illustrated configurations of the notch of FIGS. 7A–7D, and 8A–8E, respectively. Various configurations may be utilized, without limitation. For example, the notch 701 and 801 may have non-rectangular configurations.

Antennas according to the present invention may also be used with wireless communications devices which only transmit or receive radio frequency signals. In addition to devices incorporating GPS, other devices which only receive signals may include conventional AM/FM radios or other receivers utilizing an antenna. Devices which only transmit signals may include remote data input devices.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna for an electronic device, comprising:

a printed circuit board (PCB) having RF circuitry thereon, wherein the PCB has a surface and an elongated configuration that defines a first direction, the PCB including a ground plane conductor;

a notch formed in the ground plane conductor, wherein the notch comprises opposite side portions, a closed end, and an open end; and an RF signal feed electrically connected to each of the side portions and to the RF circuitry, wherein the RF signal feed is in direct physical contact with each of the side portions of the notch.

2. The antenna of claim 1, wherein the notch is formed in the ground plane conductor along a second direction transverse to the first direction.

3. The antenna of claim 2, wherein the second direction is horizontal when the PCB is oriented such that the first direction is vertical.

4. The antenna of claim 1, further comprising an impedance matching circuit that comprises at least one of a series capacitor that bridges the notch adjacent the open end and a shunt capacitor positioned adjacent a side portion of the notch.

5. The antenna of claim 1, wherein the RF signal feed comprises an unbalanced line that is connected to one side portion of the notch and that extends across the notch to the ground plane conductor on the opposite side portion of the notch.

6. The antenna of claim 1, wherein the opposite side portions are substantially parallel.

7. The antenna of claim 1, wherein the opposite side portions have a meandering configuration.

8. The antenna of claim 1, wherein the opposite side portions have a mirror image configuration.

9. The antenna of claim 1, wherein a distance between the opposite side portions adjacent the closed end of the notch is greater than a distance between the opposite side portions adjacent the open end of the notch.

10. The antenna of claim 1, wherein the PCB comprises a plurality of layers and wherein a portion of the PCB underlying the notch is void of conductors on all layers thereof.

11. A wireless communicator, comprising:

a housing configured to enclose a receiver or transmitter that receives or transmits RF signals, wherein the housing has a lower end portion and an upper end portion;

a printed circuit board (PCB) disposed within the housing, the PCB having RF circuitry thereon, wherein the PCB has a surface and an elongated configuration that defines a first direction, the PCB including a ground plane conductor;

a notch formed in the ground plane conductor, wherein the notch comprises opposite side portions, a closed end, and an open end, and wherein the notch is configured to resonate as an antenna within a selected frequency band; and an RF signal feed electrically connected to each of the notch side portions and to the RF circuitry, wherein the RF signal feed is in direct physical contact with each of the side portions of the notch.

12. The wireless communicator of claim 11, wherein the notch is formed in the ground plane conductor along a second direction transverse to the first direction.

13. The wireless communicator of claim 11, wherein the second direction is horizontal when the PCB is oriented such that the first direction is vertical.

14. The wireless communicator of claim 11, further comprising an impedance matching circuit that comprises at least one of a series capacitor that bridges the notch adjacent the open end and a shunt capacitor positioned adjacent a side portion of the notch.

15. The wireless communicator of claim 11, wherein the impedance matching circuit comprises at least one of a series capacitor that bridges the notch adjacent the open end and a shunt capacitor positioned adjacent a side portion of the notch.

16. The wireless communicator of claim 11, wherein the RF signal feed comprises an unbalanced line that is connected to one side portion of the notch and that extends across the notch to the ground plane conductor on the opposite side portion of the notch.

17. The wireless communicator of claim 11, wherein the opposite side portions are substantially parallel.

18. The wireless communicator of claim 11, wherein the opposite side portions have a meandering configuration.

19. The wireless communicator of claim 11, wherein the opposite side portions have a mirror image configuration.

20. The wireless communicator of claim 11, wherein a distance between the opposite side portions adjacent the closed end of the notch is greater than a distance between the opposite side portions adjacent the open end of the notch.

21. The wireless communicator of claim 11, wherein the PCB comprises a plurality of layers and wherein a portion of the PCB underlying the notch is void of conductors on all layers thereof.

22. The wireless communicator of claim 11, wherein the wireless communicator is a radio telephone.

23. A wireless communicator, comprising:

a housing configured to enclose primary transceiver circuitry that transmits and receives wireless communications signals, wherein the housing has a lower end portion and an upper end portion;

a primary antenna for radiating and receiving wireless communications signals;

a printed circuit board (PCB) disposed within the housing, the PCB having GPS receiver circuitry thereon, wherein the PCB has a surface and an elongated configuration that defines a first direction, the PCB including a ground plane conductor;

a notch formed in the ground plane conductor along the first direction that is configured to resonate within a selected frequency band as a GPS antenna, wherein the notch comprises opposite side portions; and a GPS signal feed electrically connected to one of the side portions and to the GPS receiver circuitry that receives GPS signals, wherein the GPS signal feed is in direct physical contact with one of the side portions of the notch.

24. The wireless communicator of claim 23, wherein the primary antenna is arranged such that it is polarized in a first polarization direction.

25. The wireless communication of claim 23, further comprising an impedance matching circuit that comprises at least one of a series capacitor that bridges the notch adjacent the open end and a shunt capacitor positioned adjacent a side portion of the notch.

26. The wireless communicator of claim 24, wherein the notch is configured such that the notch is polarized in a second polarization direction substantially orthogonal to the first polarization direction.

27. The wireless communicator of claim 26, wherein the notch has a high out-of-band VSWR.

28. The wireless communicator of claim 26, wherein the wireless communicator comprises a radiotelephone.

29. A wireless communicator, comprising:

a housing;

a printed circuit board (PCB) comprising RF circuitry and GPS circuitry, wherein the PCB has a surface and an elongated configuration that defines a first direction, the PCB including a ground plane conductor, a first notch formed in the ground plane conductor, wherein the first notch comprises opposite side portions and wherein the first notch is configured to resonate as an RF antenna within a selected frequency band;

an RF signal feed electrically connected to the first notch side portions and to the RF circuitry, wherein the RF signal feed is in direct physical contact with each of the side portions of the first notch;

a second notch formed in the ground plane conductor along the first direction, wherein the second notch is configured to resonate within a selected frequency band as a GPS antenna, wherein the second notch comprises opposite side portions; and a GPS signal feed electrically connected to the opposite side portions of the second notch and to the GPS circuitry, wherein the GPS signal feed is in direct physical contact with each of the side portions of the second notch.

30. A surface mount antenna, comprising:

a dielectric substrate having opposite first and second surfaces and opposite edge portions;

a conductive layer disposed on the first surface;

a notch formed in the conductive layer wherein the notch has opposite sides, a closed end, and an open end, and wherein the notch is configured to function as an antenna within a selected frequency band; and a conductive pattern having a third portion disposed on a first surface, a second portion, and a first portion disposed on the second surface, wherein the first, second, and third portions are electrically connected, and wherein the third portion is electrically isolated from the conductive layer disposed on the first surface, wherein the conductive pattern is configured to adjust an impedance of the notch.

31. The surface mount antenna of claim 30, wherein the dielectric substrate further comprises at least one ground pad contacting the conductive layer for grounding the conductive layer of the surface mount antenna.

32. The surface mount antenna of claim 30, wherein the conductive pattern serves as a feed pad for connecting the surface mount antenna to a feed line.

33. The surface mount antenna of claim 30, wherein the conductive pattern in conjunction with the conductive layer comprises at least one capacitor.

34. The surface mount antenna according to claim 30, wherein the conductive pattern first portion serves as at least one plate of the at least one capacitor.

35. The surface mount antenna of claim 34, wherein the conductive pattern first portion serves as at least one series capacitor plate and at least one shunt capacitor plate.

36. The surface mount antenna of claim 30, wherein the conductive pattern second portion comprises a conductive via passing through the dielectric substrate.

37. The surface mount antenna of claim 36, wherein the first and third portions are electrically connected by the conductive via.

38. The surface mount antenna of claim 30, wherein the second portion is disposed on an edge portion of the dielectric substrate.

39. A surface mount antenna, comprising:

a first dielectric substrate having opposite first and second surfaces and opposite edge portions;

a first conductive layer disposed on the first surface;

a notch formed in the first conductive layer wherein the notch has opposite sides and an open end, and wherein the notch is configured to function as an antenna within a selected frequency band;

a conductive pattern having a third portion disposed on the first surface, a second portion, and a first portion disposed on the second surface, wherein the first, second, and third portions are electrically connected and wherein the third portion is electrically isolated from the conductive layer disposed on the first surface;

a second dielectric substrate having opposite third and fourth surfaces, wherein the third surface is disposed in a contacting relationship with the first dielectric substrate second surface; and a second conductive layer disposed on the fourth surface to increase capacitance between opposite sides of the notch.

40. The surface mount antenna of claim 39, wherein the first dielectric substrate includes at least one ground pad contacting the first conductive layer for grounding the first conductive layer of the surface mount antenna.

41. The surface mount antenna of claim 39, wherein the conductive pattern serves as a feed pad for connecting the surface mount antenna to a feed line.

42. The surface mount antenna of claim 39, wherein the first and third portions are electrically connected by the second portion.

43. The surface mount antenna of claim 42, wherein the second portion comprises a conductive via passing through the first dielectric substrate.

44. The surface mount antenna of claim 42; wherein the second portion is disposed on an edge portion of the first dielectric substrate.

45. The surface mount antenna of claim 39, wherein the second conductive layer comprises a capacitive strip that extends substantially along the length of the notch.

46. The surface mount antenna of claim 45, wherein the capacitive strip serves as at least one plate of a capacitor to increase capacitance along the length of the notch.

47. A wireless communicator, comprising:

a housing;

a multi-layered printed circuit board (PCB) comprising a surface and a ground plane disposed therewithin;

a first notch formed in the ground plane, wherein the first notch comprises opposite side portions and an open end;

a plurality of contacts extending from the ground plane to the PCB surface, wherein the plurality of contacts are positioned around a periphery of the first notch;

a surface mount antenna component mounted on the plurality of contacts, the surface mount antenna component comprising:

a dielectric substrate having opposite first and second surfaces and opposite edge portions;

a conductive layer disposed on the first surface;

a second notch formed in the conductive layer wherein the second notch has second opposite sides and a second open end, and wherein the second notch is configured to function as an antenna within a selected frequency band; and a conductive pattern having a third portion disposed on the first surface, a second portion, and a first portion disposed on the second surface, wherein the first, second, and third portions are electrically connected, and wherein the third portion is electrically isolated from the conductive layer disposed on the first surface, wherein the conductive pattern is configured to adjust an impedance of the notch antenna.

48. The wireless communicator of claim 47, further comprising an RF signal feed electrically connected to the conductive pattern.

49. A wireless communicator, comprising:

a housing;

a multi-layered printed circuit board (PCB) comprising a surface and a ground plane disposed therewithin;

a first notch formed in the ground plane, wherein the first notch comprises opposite side portions and an open end;

at least one contact extending from the ground plane to the PCB surface, wherein at least one contact is positioned around a periphery of the first notch;

a surface mount antenna component mounted on at least one contact, the surface mount antenna component comprising:

a first dielectric substrate having opposite first and second surfaces and opposite edge portions;

a first conductive layer disposed on the first surface;

a second notch formed in the conductive layer wherein the second notch has opposite sides and a second open end, and wherein the second notch is configured to function as an antenna within a selected frequency band;

a conductive pattern having a third portion disposed on the first surface, a second portion, and a first portion disposed on the second surface, wherein the first, second, and third portions are electrically connected and wherein the third portion is electrically isolated from the conductive layer disposed on the first surface;

a second dielectric substrate having opposite third and fourth surfaces, wherein the third surface is disposed in a contacting relationship with the first dielectric substrate second surface; and a second conductive layer disposed on the fourth surface to increase the capacitance between the opposite sides.

50. The wireless communicator of claim 49, further comprising an RF signal feed electrically connected to the third portion and the opposite side portions.

* * * * *